US009354600B2

(12) United States Patent
Mori

(10) Patent No.: US 9,354,600 B2
(45) Date of Patent: May 31, 2016

(54) PROCESS CARTRIDGE CAPABLE OF SUPPRESSING DEVELOPER FROM LEAKING OUT OF DEVELOPER CARTRIDGE, AND IMAGE FORMING APPARATUS PROVIDED WITH THE SAME

(71) Applicant: Brother Kogyo Kabushiki Kaisha, Nagoya-shi, Aichi-ken (JP)

(72) Inventor: Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/593,000

(22) Filed: Jan. 9, 2015

(65) Prior Publication Data

US 2015/0125180 A1 May 7, 2015

Related U.S. Application Data

(63) Continuation-in-part of application No. PCT/JP2012/080839, filed on Nov. 29, 2012.

(30) Foreign Application Priority Data

Jul. 9, 2012 (JP) ..... 2012-154148

(51) Int. Cl.
*G03G 21/18* (2006.01)

(52) U.S. Cl.
CPC ..... *G03G 21/1814* (2013.01); *G03G 21/1821* (2013.01)

(58) Field of Classification Search
CPC ..... G03G 21/1814; G03G 21/1821
USPC ..... 399/113
See application file for complete search history.

(56) References Cited

U.S. PATENT DOCUMENTS 7,761,027 B2 7/2010 Takami
8,554,116 B2 10/2013 Sato (Continued)

FOREIGN PATENT DOCUMENTS

JP 2005-258024 A 9/2005
JP 2006-184316 A 7/2006

(Continued)

OTHER PUBLICATIONS

Jan. 22, 2015—(WO) International Preliminary Report on Patentability—App PCT/2012/080839.

*Primary Examiner* — David Bolduc
*Assistant Examiner* — Barnabas Fekete
(74) *Attorney, Agent, or Firm* — Banner & Witcoff, Ltd.

(57) ABSTRACT

A process cartridge includes: a developer cartridge; and a photosensitive-member cartridge. A casing of the photosensitive-member cartridge includes: a photosensitive-member accommodating portion; and a cartridge-accommodating portion disposed next to the photosensitive-member accommodating portion in a first direction. The cartridge-accommodating portion includes a first wall and a first portion. The first wall extends in the first direction and confronts the developer cartridge in a second direction intersecting the first direction. The first wall has a first end and a second end positioned farther away from the photosensitive-member accommodating portion in the first direction than the first end from the photosensitive-member accommodating portion. The first portion extends from the second end in the second direction and protrudes further than the developer cartridge in the second direction. The photosensitive-member accommodating portion includes a second portion protruding in the second direction further than a center region in the axial direction of the developer cartridge.

19 Claims, 13 Drawing Sheets

(56) References Cited

U.S. PATENT DOCUMENTS

| | | | | |
|---|---|---|---|---|
| 8,588,664 | B2 | 11/2013 | Takagi et al. | |
| 2006/0140664 | A1 | 6/2006 | Takami | |
| 2010/0329746 | A1* | 12/2010 | Sato | G03G 21/1676 399/258 |
| 2011/0158704 | A1 | 6/2011 | Takagi et al. | |
| 2014/0001597 | A1 | 1/2014 | Huang et al. | |
| 2014/0037333 | A1 | 2/2014 | Sato | |
| 2014/0153973 | A1 | 6/2014 | Takagi et al. | |

FOREIGN PATENT DOCUMENTS

| | | | |
|---|---|---|---|
| JP | 2010-217729 | A | 9/2010 |
| JP | 2011-013368 | A | 1/2011 |
| JP | 2011-133763 | A | 7/2011 |
| JP | H7-271274 | A | 9/2012 |

* cited by examiner

PROCESS CARTRIDGE CAPABLE OF SUPPRESSING DEVELOPER FROM LEAKING OUT OF DEVELOPER CARTRIDGE, AND IMAGE FORMING APPARATUS PROVIDED WITH THE SAME

CROSS REFERENCE TO RELATED APPLICATION

This application claims priority from Japanese Patent Application No. 2012-154148 filed Jul. 9, 2012. This application is also a continuation-in-part of International Application No. PCT/JP2012/080839 filed Nov. 29, 2012 in Japan Patent Office as a Receiving Office. The entire contents of both applications are incorporated herein by reference.

TECHNICAL FIELD

The present invention relates to an image forming apparatus employing an electrophotographic system and to a process cartridge that is mounted in the image forming apparatus.

BACKGROUND

A conventional electrophotographic printer known in the art has a process cartridge detachably mounted therein. The process cartridge includes a drum cartridge provided with a photosensitive drum, and a developing cartridge that accommodates developer and is detachably mounted in the drum cartridge.

One such process cartridge that has been proposed is arranged with an upper end of the developing cartridge positioned above an upper end of a drum cartridge.

SUMMARY

However, since the upper end of the developing cartridge is positioned higher than the upper end of the drum cartridge in the process cartridge described above, an impact incurred on the top of the process cartridge could act on the upper end of the developing cartridge.

For example, if the process cartridge were inadvertently dropped onto a floor surface or the like, the upper end of the developing cartridge may strike the floor surface or the like. If this occurs, the impact from the fall could be transmitted to the developing cartridge through the upper end of the developing cartridge, potentially causing developer to leak out of the developing cartridge.

In view of the foregoing, it is an object of the present invention to provide a process cartridge that, through a simple construction, can suppress developer from leaking out of a developing cartridge, even when the process cartridge incurs an impact on its top or its bottom (i.e. even when incurring an impact externally from a vertical direction). It is another object of the present invention to provide an image forming apparatus equipped with this process cartridge.

In order to attain the above and other objects, the present invention provides a process cartridge that may include: a developer cartridge; and a photosensitive member cartridge. The developer cartridge may be configured to accommodate toner therein. The photosensitive member cartridge may be configured to detachably mount the developer cartridge therein. The photosensitive member cartridge may include: a casing; and a photosensitive member supported in the casing and configured to rotate about an axis extending in an axial direction. The casing may include: a photosensitive-member accommodating portion configured to accommodate the photosensitive member therein; and a cartridge-accommodating portion disposed next to the photosensitive-member accommodating portion in a first direction and configured to accommodate the developer cartridge therein. The cartridge-accommodating portion may include a first wall and a first portion for defining a space in which the developer cartridge is accommodated. The first wall may extend in the first direction and confront the developer cartridge in a second direction intersecting the first direction. The first wall may have a first end and a second end opposite to the first end in the first direction. The second end being positioned farther away from the photosensitive-member accommodating portion in the first direction than the first end from the photosensitive-member accommodating portion. The first portion may extend from the second end in the second direction so as to protrude further than the developer cartridge in the second direction. The photosensitive-member accommodating portion may include a second portion protruding in the second direction further than a center region in the axial direction of the developer cartridge.

According to another aspect, the present invention provides an image forming apparatus that may include: a process cartridge; a main casing; and an exposure device. The process cartridge may include: a developer cartridge configured to accommodate toner therein; and a photosensitive member cartridge configured to detachably mount the developer cartridge therein. The photosensitive member cartridge may include: a casing; and a photosensitive member supported in the casing and configured to rotate about an axis extending in an axial direction. The casing may include: a photosensitive-member accommodating portion configured to accommodate the photosensitive member therein; and a cartridge-accommodating portion disposed next to the photosensitive-member accommodating portion in a first direction and configured to accommodate the developer cartridge therein. The cartridge-accommodating portion may include a first wall and a first portion for defining a space in which the developer cartridge is accommodated. The first wall may extend in the first direction and confront the developer cartridge in a second direction intersecting the first direction. The first wall may have a first end and a second end opposite to the first end in the first direction. The second end may be positioned farther away from the photosensitive-member accommodating portion in the first direction than the first end from the photosensitive-member accommodating portion. The first portion may extend from the second end in the second direction so as to protrude further than the developer cartridge in the second direction. The photosensitive-member accommodating portion may include a second portion protruding in the second direction further than a center region in the axial direction of the developer cartridge. The main casing may be configured to accommodate the process cartridge therein. The exposure device may be configured to irradiate a laser beam toward the photosensitive member along an irradiation path to expose the photosensitive member to the laser beam. The exposure device may be disposed in confrontation with and spaced apart from the process cartridge in the first direction. The first portion may be configured so as to avoid interference with the laser beam in a state where the process cartridge is mounted in the main casing.

DETAILED DESCRIPTION

1. Overall Structure of Printer

Figure 1:
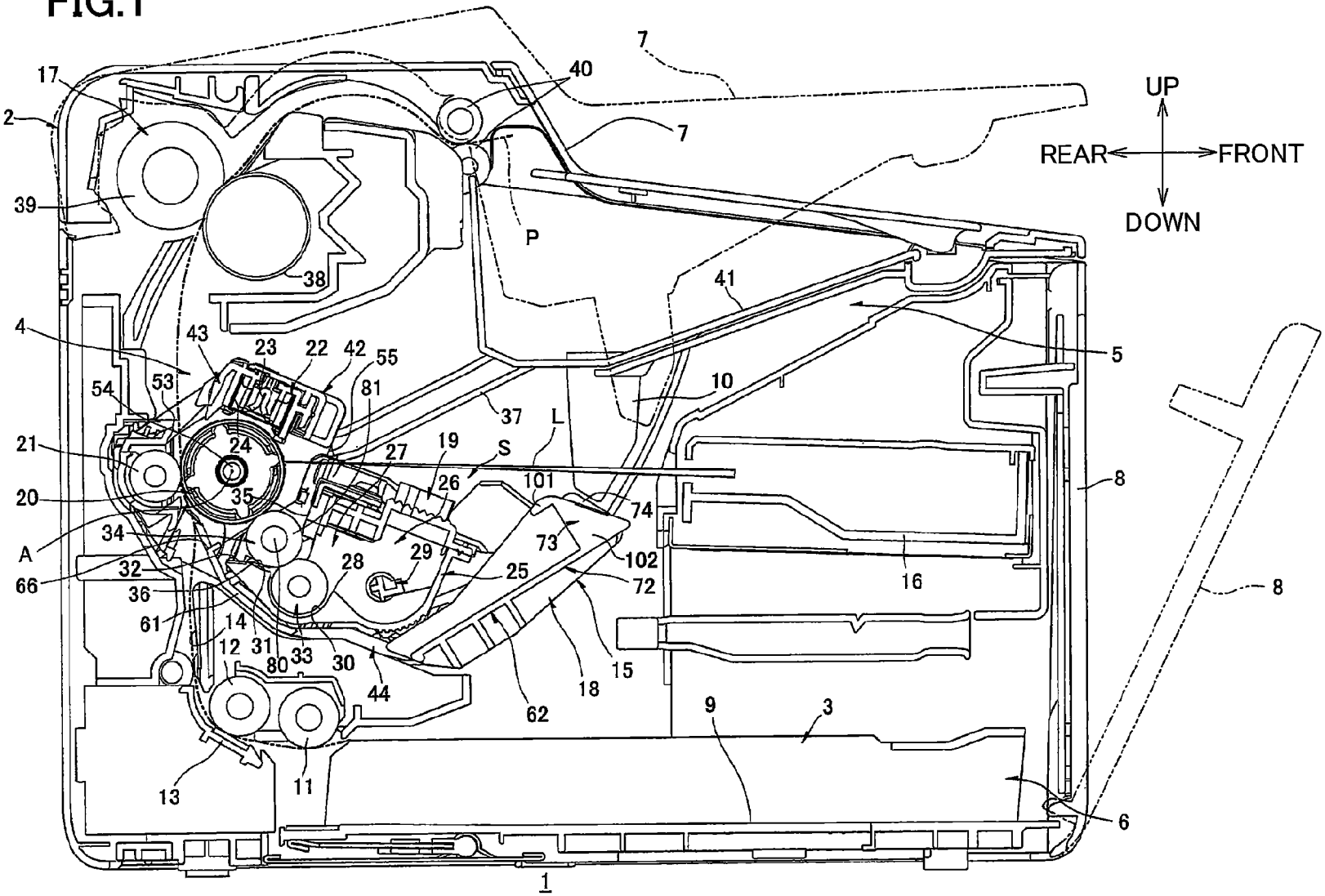
FIG. 1 is a central cross-sectional view of a printer provided with a process cartridge according to a first embodiment of the present invention.

FIG. 1 shows a printer 1 as an example of an image forming apparatus provided with a process cartridge 15 according to a first embodiment of the present invention. The printer 1 is provided with a main casing 2.

The main casing 2 has a generally box-like shape. Within the main casing 2, the printer 1 is also provided with a sheet-feeding unit 3 for feeding sheets P of paper, and an image-forming unit 4 for forming images on the sheets P supplied by the sheet-feeding unit 3.

Directions related to the printer 1 and to the process cartridge 15 (described later) will be specified based on orientations of these devices when resting on a level surface, and specifically will refer to the directions indicated by arrows in the drawings. Incidentally, a rear-to-front direction (frontward direction) is an example of a first direction; a bottom-to-top direction (upward direction) is an example of a second direction; a front-to-rear direction (rearward direction) is an example of a third direction; and a top-to-bottom direction (downward direction) is an example of a fourth direction.

The up, down, front, and rear directions related to the printer 1 differ slightly from the up, down, front, and rear directions related to the process cartridge 15 (described later). When the process cartridge 15 is mounted in the printer 1, the front side of the process cartridge 15 faces the lower front side of the printer 1, and the rear side of the process cartridge 15 faces the upper rear side of the printer 1, as shown in FIG. 1.

(1) Main Casing

Formed in the main casing 2 are a cartridge access opening 5 for mounting and removing the process cartridge 15 (described later), and a paper-introducing opening 6 through which the sheets P of paper are inserted into the main casing 2.

The cartridge access opening 5 is formed in an upper end portion of the main casing 2, penetrating the main casing 2 in a vertical direction.

The paper-introducing opening 6 is formed in a bottom portion on a front end portion of the main casing 2 and penetrates the front end portion in a front-rear direction.

The main casing 2 also includes a top cover 7 as an example of a movable member disposed on the upper end portion thereof, and a sheet-feeding cover 8 disposed on the front end portion thereof.

The top cover 7 is formed in a general plate shape that is elongated in the front-rear direction. Pressing parts 10 as an example of a pressing portion are provided on a bottom surface of the top cover 7 in an approximate front-rear center region thereof.

A plurality of (two in the embodiment) pressing parts 10 is provided to correspond to a pair of pressure-receiving parts 74 (described later; see FIG. 3) respectively provided at left and right portions of a drum cartridge 18 (described later). The two pressing parts 10 are arranged in confrontation with each other while being spaced apart from each other in a left-right direction. The pressing parts 10 have a general rectangular shape in a side view and are elongated in the left-right direction. The pressing parts 10 are formed on the bottom surface of the top cover 7 and protrude downward therefrom.

The top cover 7 is disposed so as to be capable of pivoting (moving) about its rear edge portion between a closed position for covering the cartridge access opening 5, and an open position for exposing the cartridge access opening 5 (see chain double-dashed lines in FIG. 1). That is, the top cover 7 is movable in the vertical direction.

The sheet-feeding cover 8 is formed in a generally flat plate shape that extends in the vertical direction. The sheet-feeding cover 8 is disposed so as to be capable of pivoting (moving) about its bottom edge portion between a first position for covering the paper-introducing opening 6, and a second position for exposing the paper-introducing opening 6 (see chain double-dashed lines in FIG. 1).

(2) Sheet-Feeding Unit

The sheet-feeding unit 3 includes a sheet-supporting part 9 provided in a lower portion of the main casing 2.

The sheet-supporting part 9 is in communication with an exterior of the main casing 2 through the paper-introducing opening 6.

The sheets P of paper are placed in the sheet-feeding unit 3 when the sheet-feeding cover 8 is in its second position. More specifically, the sheets P are inserted through the paper-introducing opening 6 such that rear portions of the sheets P are stacked in the sheet-supporting part 9 and front portions of the sheets P are stacked on a top surface of the sheet-feeding cover 8.

The sheet-feeding unit 3 further includes a pickup roller 11 disposed above a rear edge portion of the sheet-supporting part 9, a feeding roller 12 disposed rearward of the pickup roller 11, a feeding pad 13 arranged to confront a lower rear side of the feeding roller 12, and a feeding path 14 extending continuously upward from a rear edge of the feeding pad 13.

(3) Image-Forming Unit

The image-forming unit 4 includes the process cartridge 15, a scanning unit 16 as an example of an exposure device, and a fixing unit 17.

(3-1) Process Cartridge

The process cartridge 15 can be mounted in and removed from the main casing 2. When mounted in the main casing 2, the process cartridge 15 is arranged above a rear portion of the sheet-feeding unit 3.

The process cartridge 15 includes the drum cartridge 18 as an example of a photosensitive-member cartridge and a developing cartridge 19 as an example of a developer cartridge.

The drum cartridge 18 includes a photosensitive drum 20 as an example of a photosensitive member, a transfer roller 21, and a scorotron charger 22 as an example of a charger.

The photosensitive drum 20 is formed in a general cylindrical shape that is elongated in the left-right direction. The photosensitive drum 20 has a drum shaft 54 whose central axis A is oriented in the left-right direction (axial direction). The photosensitive drum 20 is provided in a rear portion of the drum cartridge 18 so as to be capable of rotating about the drum shaft 54.

The transfer roller 21 is formed in a general columnar shape that is elongated in the left-right direction. The transfer roller 21 is provided in the rear portion of the drum cartridge 18 so as to contact the photosensitive drum 20 with pressure on a rear side thereof.

More specifically, the transfer roller 21 is disposed on a rear side of the photosensitive drum 20 such that a central axis of the transfer roller 21 is positioned slightly lower than the central axis A of the photosensitive drum 20. Note that the transfer roller 21 has a lower peripheral surface higher than a lower peripheral surface of the photosensitive drum 20. That is, a virtual line segment (not shown) connecting the central axis of the transfer roller 21 to the central axis A of the photosensitive drum 20 forms an acute angle of approximately 3 degrees with a virtual line (not shown) extending horizontally in the front-rear direction. Accordingly, the weight of the transfer roller 21 does not affect the pressure with which the transfer roller 21 contacts the photosensitive drum 20 (transfer pressure).

The scorotron charger 22 is arranged to confront the photosensitive drum 20 on an upper-front side thereof and with a gap therebetween.

More specifically, the scorotron charger 22 is disposed at a position separated from the transfer roller 21 in a circumferential direction of the photosensitive drum 20. The scorotron charger 22 is disposed such that the virtual line segment (not shown) connecting the central axis A of the photosensitive drum 20 with the central axis of the transfer roller 21 forms an angle of approximately 120 degrees with a virtual line segment (not shown) connecting the central axis A of the photosensitive drum 20 with a charging wire 23 (described later).

The scorotron charger 22 further includes the charging wire 23 and a grid 24.

The charging wire 23 is arranged in a taut state to extend in the left-right direction and is disposed on the upper front side of the photosensitive drum 20 so as to confront but to be spaced apart from the photosensitive drum 20.

The grid 24 is formed to have a general U-shape in a side view with an opening of the "U" facing diagonally upward and forward so as to surround the charging wire 23 from a lower rear side thereof.

The developing cartridge 19 is disposed on a lower front side of the photosensitive drum 20. The developing cartridge 19 includes a developing-cartridge frame 25 as an example of a cartridge casing.

A toner-accommodating chamber 26 and a development chamber 27 are formed in the developing-cartridge frame 25. The toner-accommodating chamber 26 and the development chamber 27 are provided side by side in the front-rear direction, with a communication opening 28 allowing communication between the toner-accommodating chamber 26 and the development chamber 27. The toner-accommodating chamber 26 and the development chamber 27 have substantially the same capacity as each other.

The toner-accommodating chamber 26 accommodates toner (developer). An agitator 29 is provided in an approximate front-rear and vertical center region of the toner-accommodating chamber 26. In other words, the agitator 29 is positioned lower than the photosensitive drum 20.

In the development chamber 27 are formed a supply-roller groove 30, a developing-roller-opposing surface 31, and a lower-film-adhering surface 32 as part of a top surface of its bottom wall.

The supply-roller groove 30 is formed in a general semicircular shape conforming to a circumferential surface of a supply roller 33 (described later), with a convex shape of the supply-roller groove 30 facing obliquely downward and rearward.

The developing-roller-opposing surface 31 is formed in a general arcuate shape that conforms to a circumferential surface of a developing roller 34 (described later). The developing-roller-opposing surface 31 extends continuously from a rear edge of the supply-roller groove 30 toward upward and rearward.

The lower-film-adhering surface 32 is formed continuously with a rear edge of the developing-roller-opposing surface 31 and extends rearward therefrom. That is, the lower-film-adhering surface 32 is arranged higher than the developing-roller-opposing surface 31.

The lower-film-adhering surface 32 is also arranged to confront a bottom portion of the photosensitive drum 20 in the vertical direction, with a gap formed therebetween. The lower-film-adhering surface 32 is arranged to overlap the central axis A of the photosensitive drum 20 when projected in the vertical direction.

The supply roller 33, the developing roller 34, a thickness-regulating blade 35, and a lower film 36 are provided in the development chamber 27.

The supply roller 33 is formed in a general columnar shape that is elongated in the left-right direction. The supply roller 33 is rotatably provided in a front region of the development chamber 27 with its bottom portion disposed in the supply-roller groove 30. More specifically, the supply roller 33 is disposed on a rear side of the toner-accommodating chamber 26 and is arranged at the same approximate height in the vertical direction as the toner-accommodating chamber 26 (slightly higher than the toner-accommodating chamber 26).

The developing roller 34 is formed in a general columnar shape that is elongated in the left-right direction. The developing roller 34 is rotatably provided in a rear region of the development chamber 27 such that its bottom circumferential surface opposes the developing-roller-opposing surface 31 in the vertical direction with a gap therebetween.

The developing roller 34 is disposed so as to contact the supply roller 33 on an upper-rear side thereof. The developing roller 34 is exposed outside the development chamber 27 at its upper and rear portions, and is also disposed to contact the photosensitive drum 20 on a lower-front side thereof. In other words, the developing roller 34 is arranged on an upper-rear side of the supply roller 33 and on a lower-front side of the photosensitive drum 20. A central axis of the supply roller 33, a central axis of the developing roller 34, and the central axis A of the photosensitive drum 20 are positioned on substantially the same line following a radial direction of the photosensitive drum 20.

The developing roller 34 is also disposed at a position spaced apart from the scorotron charger 22 in the circumferential direction of the photosensitive drum 20. The developing roller 34 is arranged such that a virtual line segment (not shown) connecting the central axis A of the photosensitive drum 20 to the charging wire 23 forms an angle of approximately 120 degrees with a virtual line segment (not shown) connecting the central axis A of the photosensitive drum 20 to the central axis of the developing roller 34. Hence, the developing roller 34, the scorotron charger 22, and the transfer roller 21 are arranged at substantially equal intervals in the circumferential direction of the photosensitive drum 20.

The thickness-regulating blade 35 has an upper end fixed to a rear end of a top wall defining the development chamber 27. The thickness-regulating blade 35 has a bottom end that contacts the developing roller 34 from a front side thereof.

The lower film 36 has a rear portion fixed to the lower-film-adhering surface 32. A front edge of the lower film 36 contacts a circumferential surface of the developing roller 34 above the developing-roller-opposing surface 31.

(3-2) Scanning Unit

The scanning unit 16 is arranged frontward of the process cartridge 15 mounted in the main casing 2. More specifically, the scanning unit 16 is arranged to oppose but be spaced apart from the photosensitive drum 20 of the process cartridge 15 in the front-rear direction.

The scanning unit 16 irradiates a laser beam L for exposing the photosensitive drum 20 toward the photosensitive drum 20 based on image data, thereby exposing a circumferential surface of the photosensitive drum 20 to the laser beam L.

More specifically, the scanning unit 16 irradiates the laser beam L rearward through a position between the plurality of (two in the embodiment) pressing parts 10 to expose the circumferential surface of the photosensitive drum 20 at a front edge portion thereof to the laser beam L. In other words, an exposure point at which the photosensitive drum 20 is exposed to the laser beam L (the circumferential surface of the front edge portion of the photosensitive drum 20) is configured to be on a side opposite to a nip point at which the photosensitive drum 20 and the transfer roller 21 contact each other with respect to the central axis A of the photosensitive drum 20.

At this time, the developing cartridge 19 is arranged beneath an irradiation path of the laser beam L, while the scorotron charger 22 is arranged above the irradiation path of the laser beam L.

Guide parts 37 are respectively provided on inner surfaces of the main casing 2 opposing a space between the scanning unit 16 and the photosensitive drum 20 for guiding mounting and removal of the process cartridge 15. When removing the process cartridge 15 from the main casing 2, the guide parts 37 guide the process cartridge 15 so that the developing cartridge 19 mounted in the drum cartridge 18 moves upward, passing through the irradiation path of the laser beam L.

At this time, the various rollers provided in the process cartridge 15 (the transfer roller 21, the supply roller 33, and the developing roller 34) also move upward, passing through the irradiation path of the laser beam L.

(3-3) Fixing Unit

The fixing unit 17 is disposed above the rear portion of the drum cartridge 18. More specifically, the fixing unit 17 includes a heating roller 38 disposed above the scorotron charger 22, and a pressure roller 39 that contacts the heating roller 38 on an upper-rear side thereof with pressure.

Hence, the heating roller 38 is disposed near an upper edge (open side edge) of the grid 24 in the scorotron charger 22.

(4) Image-Forming Operation

The agitator 29 rotates to supply toner from the toner-accommodating chamber 26 of the developing cartridge 19 to the supply roller 33 through the communication opening 28. The supply roller 33 in turn supplies the toner onto the developing roller 34, at which time the toner is positively tribo-charged between the supply roller 33 and the developing roller 34.

The thickness-regulating blade 35 regulates the thickness of toner supplied to the developing roller 34 as the developing roller 34 rotates so that a thin layer of toner of uniform thickness is carried on the surface of the developing roller 34.

In the meantime, the scorotron charger 22 uniformly charges the surface of the photosensitive drum 20. The scanning unit 16 subsequently exposes the surface of the photosensitive drum 20 to the laser beam L, forming an electrostatic latent image on the circumferential surface of the photosensitive drum 20 based on image data. Next, the toner carried on the developing roller 34 is supplied to the electrostatic latent image on the circumferential surface of the photosensitive drum 20 so that a toner image (developer image) is carried on the circumferential surface of the photosensitive drum 20.

The rotating pickup roller 11 supplies the sheets P stacked on the sheet-supporting part 9 between the feeding roller 12 and the feeding pad 13, and the rotating feeding roller 12 separates the sheets P, conveys each separated sheet P onto the feeding path 14, and supplies the sheets P one at a time to the image-forming unit 4 (between the photosensitive drum 20 and the transfer roller 21) at a prescribed timing.

The sheet P is conveyed upward between the photosensitive drum 20 and the transfer roller 21, at which time the toner image is transferred from the photosensitive drum 20 onto the sheet P, forming an image on the sheet P.

Next, the sheet P passes between the heating roller 38 and the pressure roller 39. At this time, the heating roller 38 and the pressure roller 39 apply heat and pressure to the sheet P to thermally fix the image to the sheet P.

The sheet P is subsequently conveyed toward discharge rollers 40. The discharge rollers 40 discharge the sheet P onto a discharge tray 41 formed on a top surface of the main casing 2.

In this way, the sheet P is supplied from the sheet-supporting part 9 and conveyed along a conveying path that has a general C-shape in a side view, passing first between the photosensitive drum 20 and the transfer roller 21 (nip point) and next between the heating roller 38 and the pressure roller 39, and subsequently being discharged onto the discharge tray 41.

2. Detailed Description of Process Cartridge

Figure 2:
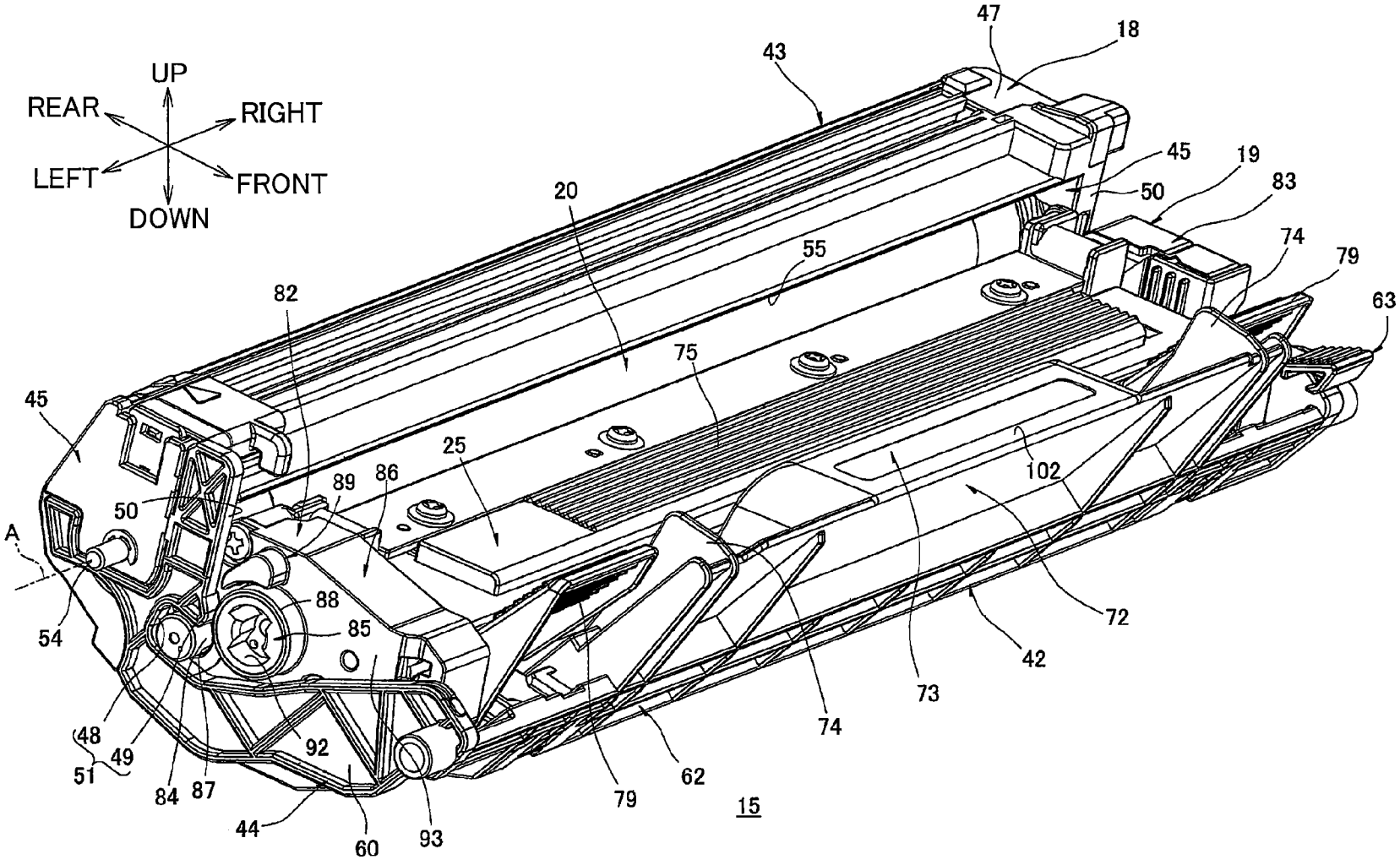
FIG. 2 is a perspective view of the process cartridge shown in FIG. 1 as viewed from its upper-left side.

As shown in FIG. 2, the process cartridge 15 includes the drum cartridge 18 that is detachably mounted in the main casing 2 (see FIG. 1), and the developing cartridge 19 that is detachably mounted in the drum cartridge 18.

(1) Drum Cartridge

Figure 3:
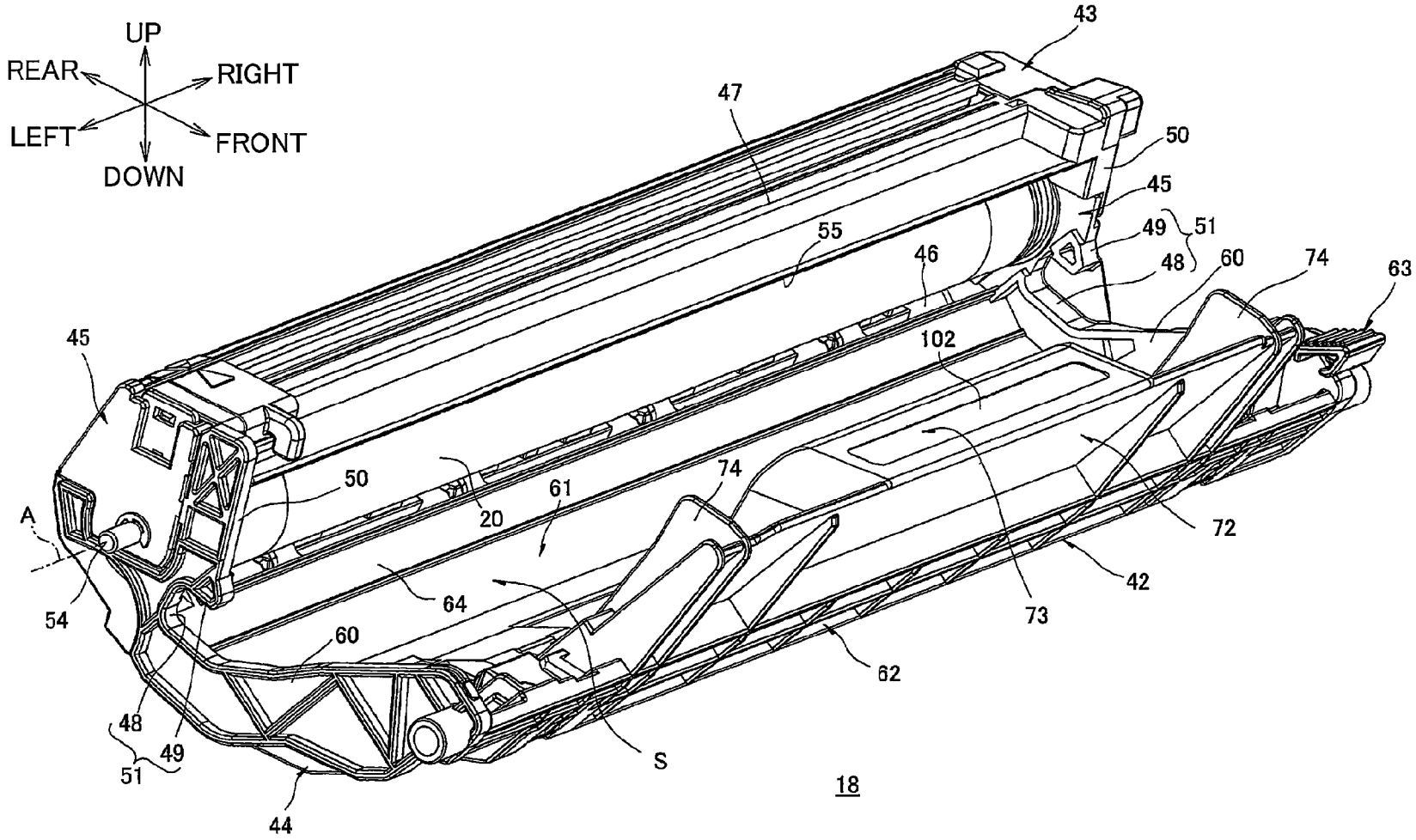
FIG. 3 is a perspective view of a drum cartridge shown in FIG. 2 as viewed from its upper-left side.

As shown in FIG. 3, the drum cartridge 18 is provided with a drum frame 42 as an example of a casing.

Figure 10:
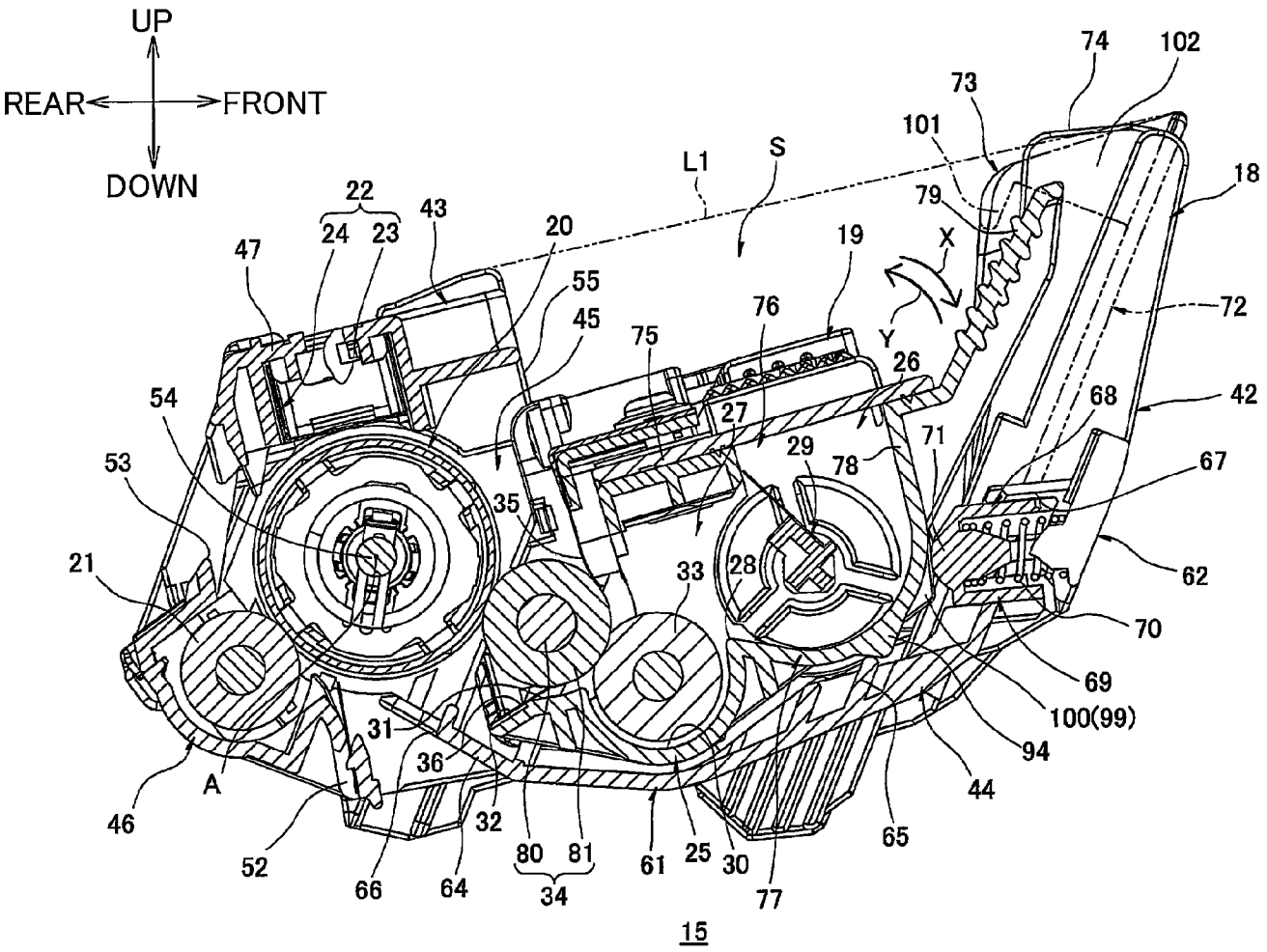
FIG. 10 is a cross-sectional view of the process cartridge taken along a line A-A shown in FIG. 9A

The drum frame 42 has a general rectangular frame-like structure with a closed bottom. The drum frame 42 has a rear portion constituting a drum-accommodating portion 43 as an example of a photosensitive-member accommodating portion. The drum frame 42 has a front portion constituting a cartridge-mounting portion 44 as an example of a cartridge-accommodating portion. Hence, the cartridge-mounting portion 44 is disposed on a front side of the drum-accommodating portion 43 so as to be adjacent to the drum-accommodating portion 43 in the front-rear direction, as shown in FIG. 10.

(1-1) Drum-Accommodating Portion

As shown in FIG. 3, the drum-accommodating portion 43 has a general box-like shape that is elongated in the left-right direction and is open on front and bottom sides thereof (see also FIG. 1). The drum-accommodating portion 43 includes a pair of accommodating-portion side walls 45 that is arranged to confront each other and spaced apart from each other in the left-right direction, a transfer-roller support portion 46 (see FIG. 10) that is coupled to bottom edges of the accommodating-portion side walls 45 at rear portions thereof, and a top wall 47 (an example of a second portion) that is coupled to top edges of the accommodating-portion side walls 45.

Figure 5:
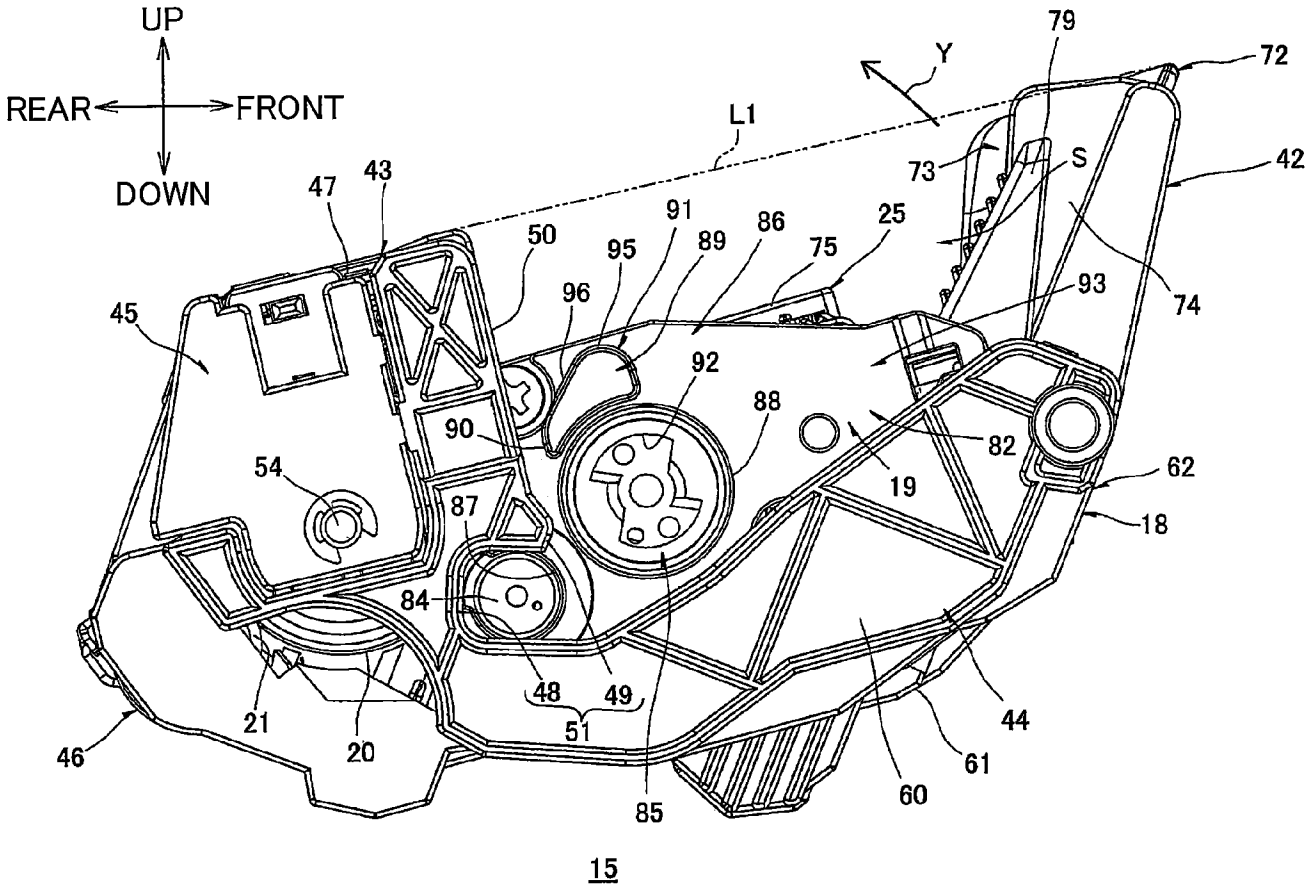
FIG. 5 is an explanatory view explaining operations for mounting and removing the developing cartridge relative to the drum cartridge, in which a left side view of the process cartridge is shown and the developing cartridge has been mounted in the drum cartridge.

As shown in FIG. 5, each of the accommodating-portion side walls 45 has a general plate shape that is substantially rectangular in a side view and elongated in the vertical and front-rear directions.

A guide part 51 is provided in a front edge portion of each accommodating-portion side wall 45 at a lower portion thereof.

The guide part 51 is provided with a guiding groove 48 as an example of a groove portion, and a retaining part 49.

The guiding groove 48 is a recess formed in a front edge of the corresponding accommodating-portion side wall 45. In a side view, the guiding groove 48 has a general U-shape that is open on a front side thereof. The guiding groove 48 has a width (vertical dimension) approximately equal to (slightly greater than) an outer diameter of a collar member 84 (described later) provided in the developing cartridge 19.

The retaining part 49 is formed above the guiding groove 48 and has a general triangular shape in a side view, with a vertex of the triangle pointing diagonally downward and forward from the front edge of the corresponding accommodating-portion side wall 45. Further, the retaining part 49 has a bottom edge formed continuously with a top edge defining the guiding groove 48.

The front edge of the accommodating-portion side wall 45 positioned above the retaining part 49 is defined as a contact-receiving part 50.

Figure 9A:
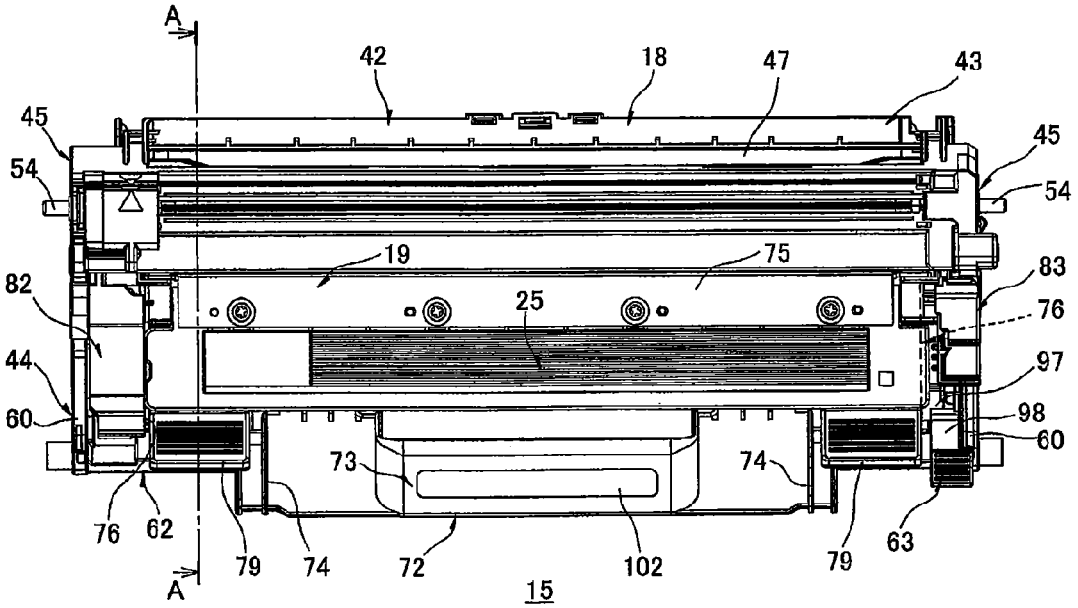
FIG. 9A is a plan view of the process cartridge shown in FIG. 2.
Figure 9B:
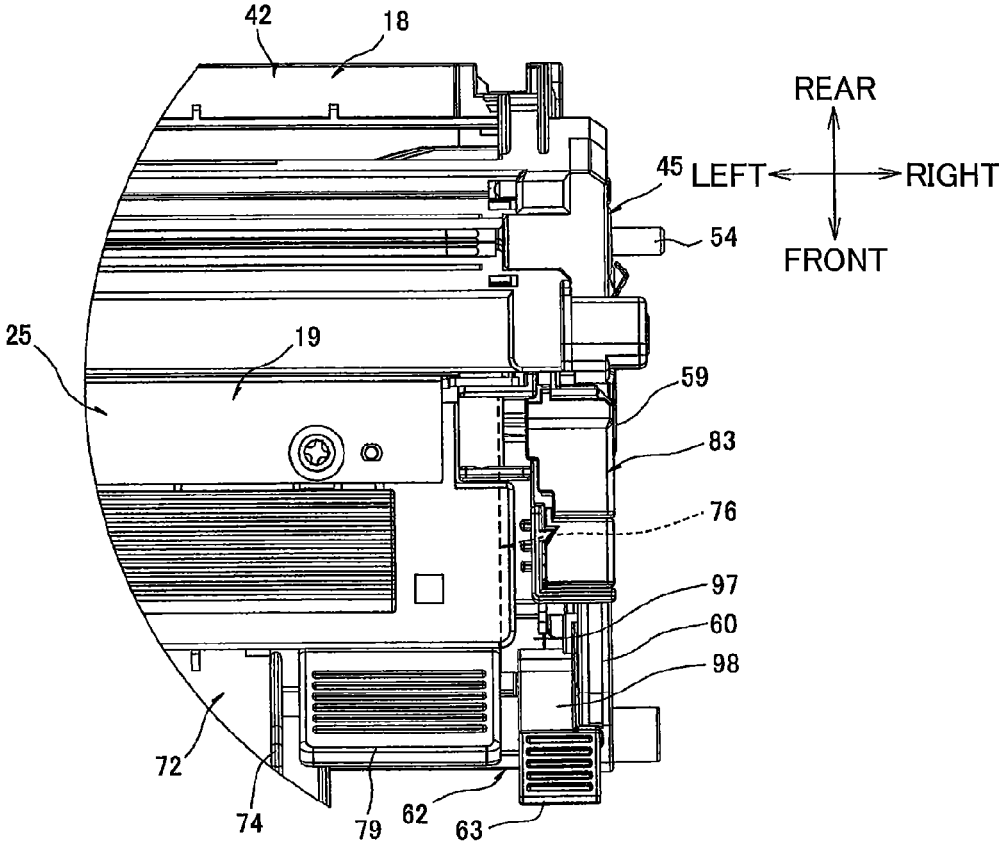
FIG. 9B is an enlarged view of a right portion of the process cartridge shown in FIG. 9A.

As shown in FIG. 9B, a thick-walled part 59 is integrally provided on a right surface of the right accommodating-portion side wall 45 at a lower-front portion thereof.

The thick-walled part 59 has a general rectangular shape in a plan view and protrudes slightly rightward from the right surface of the right accommodating-portion side wall 45.

As shown in FIG. 10, the transfer-roller support portion 46 is formed in a general U-shape in a side cross-section so as to follow a circumferential surface of the transfer roller 21. The U-shaped transfer-roller support portion 46 has an opening facing diagonally upward and forward.

A first lip portion 52 (see FIG. 10) is integrally provided in the transfer-roller support portion 46.

The first lip portion 52 is formed in a general plate shape that extends continuously downward from a front edge of the transfer-roller support portion 46.

As shown in FIG. 3, the top wall 47 is formed in a general plate shape that is elongated in the left-right direction.

As shown in FIG. 10, an open region between the top wall 47 and a top edge of the transfer-roller support portion 46 is defined as a sheet-discharge opening 53. Sheets P passing through a nip point between the photosensitive drum 20 and the transfer roller 21 are discharged through the sheet-discharge opening 53.

The drum-accommodating portion 43 accommodates the photosensitive drum 20, the transfer roller 21, and the scorotron charger 22 therein.

The photosensitive drum 20 and the transfer roller 21 are supported between the pair of accommodating-portion side walls 45.

The photosensitive drum 20 is rotatably supported about its central axis A (as an example of an axis) relative to the pair of accommodating-portion side walls 45 by disposing left and right end portions of the drum shaft 54 in approximate front-rear and vertical center portions of the corresponding accommodating-portion side walls 45 so that the left and right end portions of the drum shaft 54 penetrate the corresponding accommodating-portion side walls 45 and protrude outward therefrom in the left-right direction (see FIG. 3).

The transfer roller 21 is disposed in the transfer-roller support portion 46 and is rotatably supported in the pair of accommodating-portion side walls 45 with its left and right ends disposed in lower rear portions of the corresponding accommodating-portion side walls 45.

Note that the transfer roller 21 has a left-right dimension shorter than that of the photosensitive drum 20. Hence, in order to support the transfer roller 21, the left-right distance between the pair of accommodating-portion side walls 45 is shorter in the lower rear portions thereof than in remaining portions thereof, as shown in FIG. 3. In other words, the accommodating-portion side walls 45 have a crank-like shape in a plan view, with their rear ends positioned farther inward in the left-right direction.

The scorotron charger 22 is embedded in the top wall 47. The grid 24 of the scorotron charger 22 has a bottom edge portion exposed in a bottom surface of the top wall 47 and confronts a top portion of the photosensitive drum 20.

(1-2) Cartridge-Mounting Portion

As shown in FIG. 3, the cartridge-mounting portion 44 has a general box-like shape and is open on top and rear sides thereof to allow mounting and removal of the developing cartridge 19. The cartridge-mounting portion 44 includes a pair of mounting-portion side walls 60 that is arranged to confront each other and spaced apart from each other in the left-right direction, a mounting-portion bottom wall 61 as an example of a first wall that is coupled to bottom edges of the mounting-portion side walls 60, and a front wall 62 that is coupled to front edges of the mounting-portion side walls 60.

As shown in FIG. 5, each of the mounting-portion side walls 60 has a general plate shape that is formed continuously with a front edge of the corresponding accommodating-portion side wall 45 at a lower end portion thereof and extends diagonally upward toward the front. Each of the mounting-portion side wall 60 has a top edge that is formed to extend continuously upward toward the front from a bottom edge of the guiding groove 48. The contact-receiving part 50, the retaining part 49, the guiding groove 48, and the top edge of the mounting-portion side wall 60 configure an example of a guide portion. The accommodating-portion side walls 45 and the mounting-portion side walls 60 constitute an example of a second wall possessing the guide portion.

As shown in FIG. 10, the mounting-portion bottom wall 61 is formed in a general plate shape that extends in the front-rear direction. The mounting-portion bottom wall 61 is positioned frontward of and spaced apart from the first lip portion 52. Further, the mounting-portion bottom wall 61 integrally includes a second lip portion 64, and a pair of contact-receiving parts 65.

The second lip portion 64 has a general plate shape that extends diagonally upward and rearward continuously from a rear edge of the mounting-portion bottom wall 61. The second lip portion 64 has a rear edge that is positioned spaced apart from the first lip portion 52 in the front-rear direction. An open region between the rear edge of the second lip portion 64 and the front edge of the first lip portion 52 is defined as a sheet-feed opening 66. Sheets P are supplied to the nip point between the photosensitive drum 20 and the transfer roller 21 through the sheet-feed opening 66.

The left and right edges of the second lip portion 64 are coupled to inner left-right surfaces of the corresponding accommodating-portion side walls 45 at bottom edge portions thereof.

The contact-receiving parts 65 as an example of a contact-receiving portion are provided on a top surface of the mounting-portion bottom wall 61 at a front region thereof. The contact-receiving parts 65 are provided on left and right ends of the mounting-portion bottom wall 61 (see FIG. 8) so as to oppose a pair of contact parts 94 (described later) of the developing-cartridge frame 25 when the developing cartridge 19 is in a mounted state (described later). The contact-receiving parts 65 are formed as ridges that are elongated in the left-right direction (see FIG. 8). The contact-receiving parts 65 are also formed in a general rectangular shape in a side view and protrude diagonally upward and forward from the top surface of the mounting-portion bottom wall 61. Distal edges (top edges) of the contact-receiving parts 65 are rounded to form a general arcuate shape in cross-section.

The front wall 62 is formed continuously with a front edge of the mounting-portion bottom wall 61 so as to slope diagonally upward toward the front.

Figure 8:
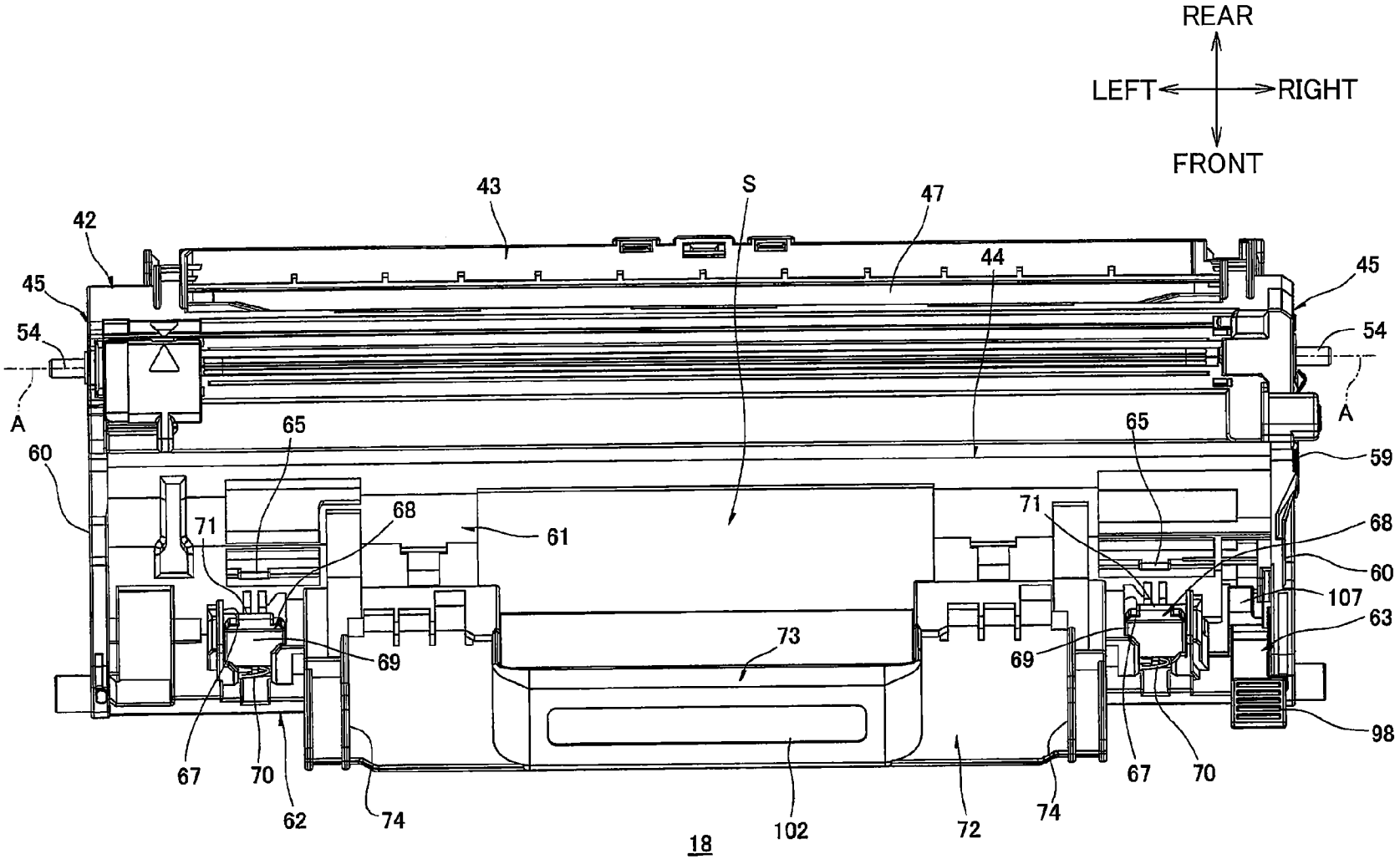
FIG. 8 is a plan view of the drum cartridge shown in FIG. 3.

As shown in FIG. 8, a plurality of (two in the embodiment) pressing-member accommodating portions 67 is formed on a rear surface of the front wall 62.

The pressing-member accommodating portions 67 are provided at left and right end portions of the rear surface of the front wall 62 at positions for confronting left and right end portions of a developing-cartridge front wall 78 (described later, see FIGS. 4 and 10) when the developing cartridge 19 is in a mounted state (described later).

As shown in FIG. 10, the pressing-member accommodating portions 67 are formed in a general U-shape in a side view and are recessed frontward into the rear surface of the front wall 62.

The drum-accommodating portion 43 and the cartridge-mounting portion 44 are in communication via a frame opening 55 defined by a front edge of the top wall 47, the rear edge of the mounting-portion bottom wall 61, and inner left-right surfaces on the front edges of the corresponding accommodating-portion side walls 45.

As shown in FIG. 3, the cartridge-mounting portion 44 is also provided with a locking lever 63 as an example of a restricting member, a plurality of (two in the embodiment) pressing members 68 (see FIG. 8), and an extension part 72.

As shown in FIG. 8, the locking lever 63 is provided on the right mounting-portion side wall 60.

More specifically, the locking lever 63 is positioned on a left side of a front portion of the mounting-portion side wall 60. The locking lever 63 integrally includes a rotational shaft (not shown), a lifting part 107 disposed below the rotational shaft, and a restricting part 98 disposed above the rotational shaft.

The restricting part 98 is formed in a general plate shape that is substantially rectangular in a plan view.

With the rotational shaft (not shown) of the locking lever 63 rotatably supported in the right mounting-portion side wall 60, the locking lever 63 is capable of pivotally moving between a first orientation for restricting removal of the developing cartridge 19 from the drum cartridge 18, and a second orientation for allowing removal of the developing cartridge 19 from the drum cartridge 18. In other words, the locking lever 63 is provided such that the lifting part 107 can move in the vertical direction relative to the right mounting-portion side wall 60 and the restricting part 98 can move in the front-rear direction relative to the right mounting-portion side wall 60.

As shown in FIG. 9B, an urging member (not shown) constantly urges the locking lever 63 toward the first orientation in which a rear end of the restricting part 98 is positioned farther rearward than a rear end of the restricting part 98 when the locking lever 63 is in the second orientation.

The pressing members 68 are provided in the corresponding pressing-member accommodating portions 67 of the front wall 62. As shown in FIG. 8, in a plan view, the pressing members 68 are disposed on a front side of the corresponding contact-receiving parts 65 so as to be juxtaposed with the corresponding contact-receiving parts 65 in the front-rear direction. As shown in FIG. 10, in a side view, the pressing members 68 are disposed on an upper front side of the corresponding contact-receiving parts 65 and specifically on a downstream side in a removal direction Y (described later).

Each pressing member 68 includes a body part 69, and a spring member 70.

The body part 69 is formed in a general square cylindrical shape that is closed on a rear end thereof. A projecting part 71 is integrally provided on a rear surface of the body part 69. As shown in FIG. 10, the projecting part 71 is formed in a general arcuate shape in a side view and projects rearward from an approximate center region on the rear surface of the body part 69.

The spring member 70 is a compression coil spring that extends in the front-rear direction. The spring member 70 is accommodated in an internal space formed in the body part 69.

Each pressing member 68 is arranged such that the spring member 70 is sandwiched between an inner front surface on the rear end of the body part 69 and a rear surface of the pressing-member accommodating portion 67. Through this arrangement, the urging force of the spring member 70 constantly urges the body part 69 rearward.

As shown in FIG. 3, the extension part 72 is provided integrally with the front wall 62. Here, the front wall 62 and the extension part 72 constitute an example of a first portion.

The extension part 72 is formed in a general plate shape that is elongated in the left-right direction (axial direction). The extension part 72 is formed continuously with a top edge of the front wall 62 at an approximate left-right center region thereof. The extension part 72 extends diagonally upward toward the front along a slope substantially equivalent to the slope of the front wall 62 (see FIG. 10).

In other words, the extension part 72 is disposed on a front side of and spaced apart from the drum-accommodating portion 43. A top edge of the extension part 72 is positioned farther forward than a bottom edge of the front wall 62.

The extension part 72 integrally includes a drum grip part 73 as an example of a grip portion, and the pair of pressure-receiving parts 74.

As shown in FIG. 3, the drum grip part 73 is provided in the approximate left-right center region on a rear surface of the extension part 72. The drum grip part 73 integrally includes a grip portion 102 as an example of a protruding wall, and a ridge part 101 (see FIG. 10).

As shown in FIG. 10, the grip portion 102 is formed in a general triangular shape in a side view and protrudes rearward from the rear surface of the extension part 72 at a top portion thereof. The grip portion 102 is elongated in the left-right direction (see FIG. 3).

More specifically, a top surface of the grip portion 102 slopes continuously downward toward the rear from the top edge of the extension part 72. Hence, the top surface of the grip portion 102 is positioned lower at its rear end than at its front end, so as to slope toward the mounting-portion bottom wall 61 from the front to the rear. A bottom surface of the grip portion 102 slopes continuously downward from its rear edge toward its front edge.

The ridge part 101 is formed in a general rectangular shape in a side view and protrudes diagonally downward and rearward from the bottom surface of the grip portion 102 at the rear edge thereof and is elongated in the left-right direction. Through this configuration, the drum grip part 73 (grip portion 102 and ridge part 101) and the extension part 72 form a general inverted J-shape in a side view.

As shown in FIG. 3, the pressure-receiving parts 74 are provided on the rear surface of the extension part 72, with one on each of left and right end portions thereof. The pressure-receiving parts 74 respectively confront but are spaced apart from left and right ends of the grip portion 102 from outer left-right sides thereof As shown in FIG. 10, the pressure-receiving parts 74 are formed in a general plate shape and protrude rearward from the rear surface of the extension part 72. In a side view, the pressure-receiving parts 74 are formed in a general triangular shape with a vertex projecting upward and rearward.

More specifically, a top edge of each pressure-receiving part 74 extends continuously rearward from the top edge of the extension part 72, while a rear edge of each pressure-receiving part 74 curves and extends downward from a rear end of the top edge.

As shown in FIG. 3, an interior of the cartridge-mounting portion 44 includes a mounting space S (as an example of a space) for accommodating the developing cartridge that is defined by a front edge of the drum-accommodating portion 43, the top surface of the mounting-portion bottom wall 61, inner left-right surfaces of the mounting-portion side walls 60, the rear surface of the front wall 62, and the rear surface of the extension part 72.

(2) Developing Cartridge

Figure 4:
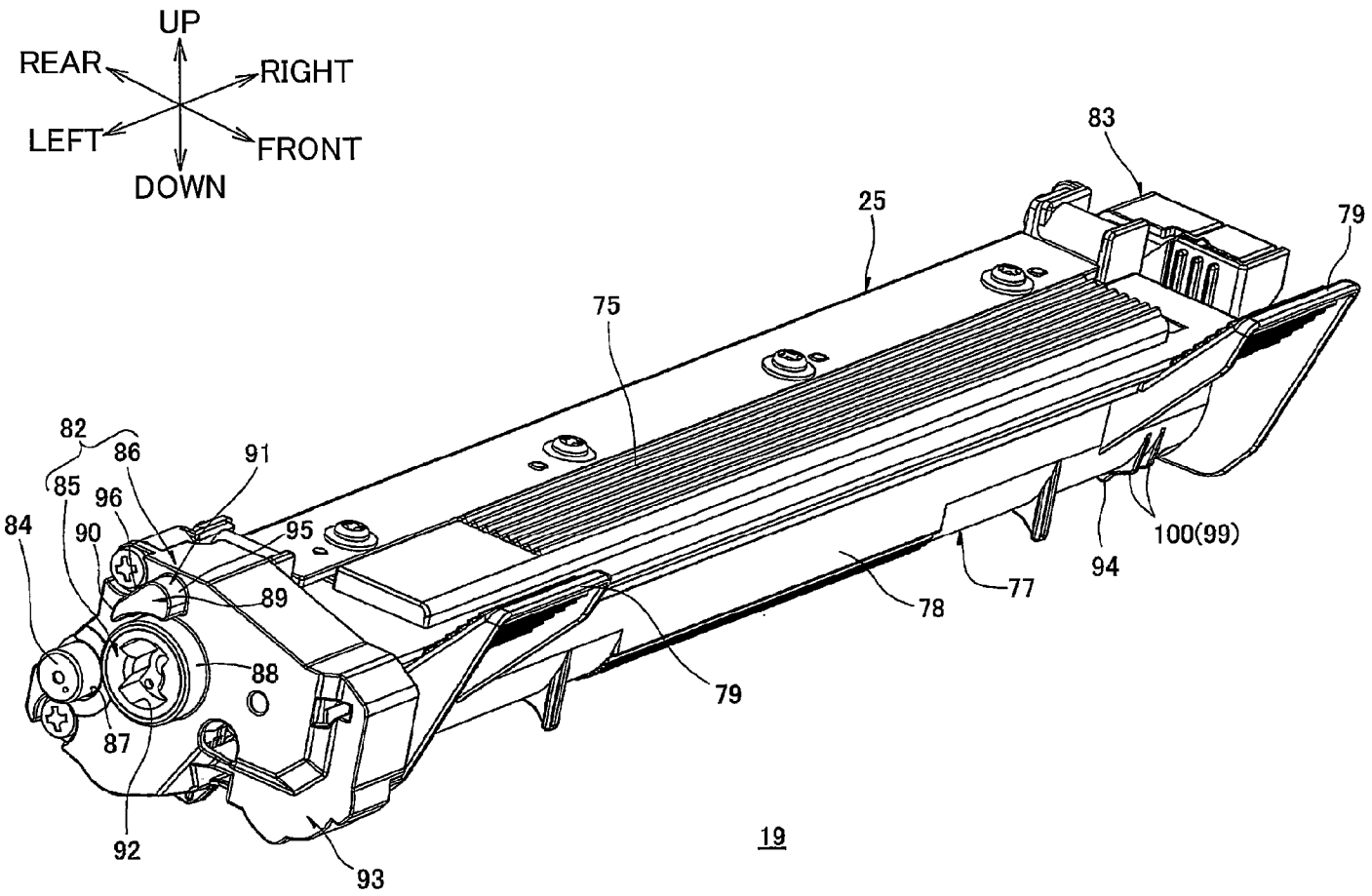
FIG. 4 is a perspective view of a developing cartridge shown in FIG. 2 as viewed from its upper left side.

As shown in FIG. 4, the developing cartridge 19 is provided with the developing-cartridge frame 25 described above.

The developing-cartridge frame 25 is formed in a general box-like shape that is elongated in the left-right direction (see also FIG. 10). The developing-cartridge frame 25 includes a pair of developing-cartridge side walls 76 (see FIG. 9A) that are spaced apart from and oppose each other in the left-right direction, a developing-cartridge bottom wall 77 (see also FIG. 10) that connects bottom edges of the developing-cartridge side walls 76, the developing-cartridge front wall 78 (see also FIG. 10) that connects front edges of the developing-cartridge side walls 76, and a developing-cartridge top wall 75 (see also FIG. 10) that connects top edges of the developing-cartridge side walls 76.

As shown in FIG. 10, the developing-cartridge side walls 76 are formed in a general plate shape that is substantially rectangular in a side view and elongated in the vertical and front-rear directions.

As shown in FIG. 9B, the right developing-cartridge side wall 76 is provided with a restriction part 97 as an example of a restriction portion, and a protruding part (not shown).

The restriction part 97 is provided on the right surface of the right developing-cartridge side wall 76 at its front end portion thereof. The restriction part 97 is formed in a general rectangular shape in a plan view and protrudes rightward from the right surface of the developing-cartridge side wall 76.

The protruding part (not shown) is provided rearward of the restriction part 97 at a position opposing the lifting part 107 of the locking lever 63 (see FIG. 8). The protruding part protrudes rightward from the right surface of the right developing-cartridge side wall 76.

As shown in FIG. 10, the developing-cartridge bottom wall 77 is formed in a general plate shape that is elongated in the front-rear direction. A pair of pressure-receiving parts 99 and the pair of contact parts 94 are provided on a bottom surface of the developing-cartridge bottom wall 77.

As shown in FIG. 4, the pressure-receiving parts 99 are provided on the bottom surface of the developing-cartridge bottom wall 77 at a front end thereof. The pressure-receiving parts 99 are provided on the left and right ends of the developing-cartridge bottom wall 77 (see FIG. 4) to correspond to the plurality of (two) pressing members 68.

Each of the two pressure-receiving parts 99 has a pair of protruding parts 100 arranged spaced apart from each other and in opposition to each other in the left-right direction.

As shown in FIG. 10, the protruding parts 100 are formed in a general plate shape and are substantially triangular in a side view. The protruding parts 100 protrude diagonally downward and forward from the bottom surface of the developing-cartridge bottom wall 77.

More specifically, front edges of the protruding parts 100 extend downward from the bottom surface of the developing-cartridge bottom wall 77, and bottom edges of the protruding parts 100 bend and extend diagonally downward and rearward from bottom ends of the front edges.

The contact parts 94 as an example of a contact portion are provided on the left and right ends of the developing-cartridge bottom wall 77 to correspond to the plurality of (two) contact-receiving parts 65. The contact parts 94 are respectively positioned between the corresponding pairs of protruding parts 100 when projected in the front-rear direction (see FIG. 4). The contact parts 94 are also positioned downward and rearward of the corresponding pressure-receiving parts 99 (see FIG. 10).

The contact parts 94 are formed in a general plate shape and are substantially triangular in a side view. A vertex of the triangular-shaped contact part 94 points downward and forward so that the contact part 94 protrudes downward from the bottom surface of the developing-cartridge bottom wall 77. More specifically, a front edge of each contact part 94 extends diagonally downward and rearward from the bottom surface of the developing-cartridge bottom wall 77, and a bottom edge of the contact part 94 bends and extends upward and rearward from a bottom end of the front edge.

The developing-cartridge front wall 78 has a general plate shape and extends continuously upward from a front edge of the developing-cartridge bottom wall 77.

The developing-cartridge top wall 75 is formed in a general plate shape and extends continuously rearward from a top edge of the developing-cartridge front wall 78.

The developing roller 34 is provided in the development chamber 27 of the developing-cartridge frame 25. A pair of developing-cartridge grip parts 79 as an example of a hand-grip is integrally provided on a front edge portion of the developing-cartridge frame 25.

The developing roller 34 includes a metal developing-roller shaft 80 that extends in the left-right direction, and a rubber developing-roller body 81 that covers the developing-roller shaft 80 while leaving left and right end portions of the developing-roller shaft 80 exposed.

The developing roller 34 is rotatably supported relative to the developing-cartridge side walls 76, with the left and right end portions of the developing-roller shaft 80 disposed at rear edge portions of the corresponding developing-cartridge side walls 76 so as to penetrate the corresponding developing-cartridge side walls 76 and protrude outward therefrom in the left-right direction.

As shown in FIG. 4, the collar member 84 as an example of a guided portion is provided on each of the left and right end portions (protruding portions) of the developing-roller shaft 80.

The collar members 84 are formed in a general cylindrical shape that is elongated in the left-right direction and closed on an outer left-right end thereof. An inner diameter of the collar members 84 is approximately equal to (slightly greater than) an outer diameter of left-right end portions of the developing-roller shaft 80. The collar members 84 are fitted with the left and right end portions of the developing-roller shaft 80 such that the left and right end portions of the developing-roller shaft 80 are inserted into interior spaces formed in the collar members 84.

The developing-cartridge grip parts 79 are formed in a general plate shape that is substantially rectangular in a front view. The developing-cartridge grip parts 79 are provided on a front surface of the developing-cartridge front wall 78 with one on each of left and right end portions thereof. As shown in FIG. 10, the developing-cartridge grip parts 79 are formed continuously with the top edge on the front surface of the developing-cartridge front wall 78 and slope upward toward the front.

As shown in FIG. 4, the developing cartridge 19 further includes a drive unit 82 provided on an outer surface (left surface) of the left developing-cartridge side wall 76, and a power supply unit 83 as an example of an electrode provided on an outer surface (right surface) of the right developing-cartridge side wall 76.

The drive unit 82 includes a development coupling 85, and a gear cover 86.

The development coupling 85 is formed in a general columnar shape that is elongated in the left-right direction. The development coupling 85 is rotatably supported on the left developing-cartridge side wall 76 (see FIG. 9A).

The development coupling 85 has a left endface formed with a coupling recess 92. The coupling recess 92 is formed in a general shape of an elongate hole in a side view that is elongated in a radial direction of the development coupling 85. The coupling recess 92 is recessed rightward from the left endface of the development coupling 85. A coupling protrusion (not shown) of a main coupling (not shown) provided in the main casing 2 is fitted into the coupling recess 92 for transmitting a drive force from the printer 1.

The gear cover 86 is formed in a general box-like shape that is open on right and rear sides thereof. The gear cover 86 is fixed to the left developing-cartridge side wall 76 of the developing-cartridge frame 25 (see FIG. 9A) so as to accommodate the development coupling 85 therein.

The gear cover 86 has a left wall 93 formed in a general plate shape that is elongated in the vertical and front-rear directions. The left wall 93 is provided with a collar exposure groove 87, a coupling collar 88, and a contact part 89.

The collar exposure groove 87 is formed in a general C-shape in a side view, with an opening of the "C" facing upward and rearward so as to appear cutout in a rear edge of the left wall 93 in a direction downward and forward. The collar exposure groove 87 has a width (inner diameter) slightly greater than the outer diameter of the collar member 84. The collar member 84 is inserted into the collar exposure groove 87 while protruding leftward therefrom.

The coupling collar 88 is formed in a general cylindrical shape and extends leftward from the left wall 93 at a position on an upper front side of the collar exposure groove 87. The coupling collar 88 has a right end in communication with an interior (right end) of the gear cover 86. The development coupling 85 has a left end inserted into the coupling collar 88 with the coupling recess 92 exposed on an outside.

The contact part 89 is formed in a general columnar shape and protrudes leftward from the left surface of the left wall 93 at a position above the coupling collar 88.

As shown in FIG. 5, the contact part 89 is formed in a general talon-like shape in a side view and is elongated in a direction between the upper front to the lower rear. Upper and rear surfaces of the contact part 89 are defined as a curved guide surface 91 as an example of an abutting portion.

The curved guide surface 91 includes an upper surface 95 defined on a top portion of the contact part 89, a rear surface 90 defined on a rear end portion of the contact part 89, and a connecting surface 96 defined between the upper surface 95 and the rear surface 90.

The upper surface 95 is formed in a general arcuate shape in a side view on the top portion of the contact part 89, with its convex side facing upward.

The connecting surface 96 is formed continuously from a rear edge of the upper surface 95 and slopes diagonally downward toward the rear.

The rear surface 90 is formed to bend and extend downward from a rear edge of the connecting surface 96.

A curved guide surface 91 having a shape and arrangement that is symmetrical to this curved guide surface 91 with respect to the left-right direction is also provided on the power supply unit 83 disposed on a right side of the developing-cartridge frame 25.

As shown in FIG. 1, the power supply unit 83 can be electrically connected to a main electrode (not shown, an example of an external power supply) provided in the main casing 2 when the process cartridge 15 is mounted in the main casing 2.

As shown in FIG. 9B, the power supply unit 83 is formed in a general rectangular shape in a plan view and is elongated in the front-rear direction. The power supply unit 83 is configured of a supply electrode (not shown) that is electrically connected to the supply roller 33, a developing electrode (not shown) that is electrically connected to the developing roller 34, and the like.

3. Operations for Mounting and Removing Developing Cartridge Relative to Drum Cartridge Next, operations for mounting the developing cartridge 19 in the drum cartridge 18 and removing the developing cartridge 19 from the drum cartridge 18 will be described.

(1) Operation for Mounting Developing Cartridge in Drum Cartridge

Figure 7:
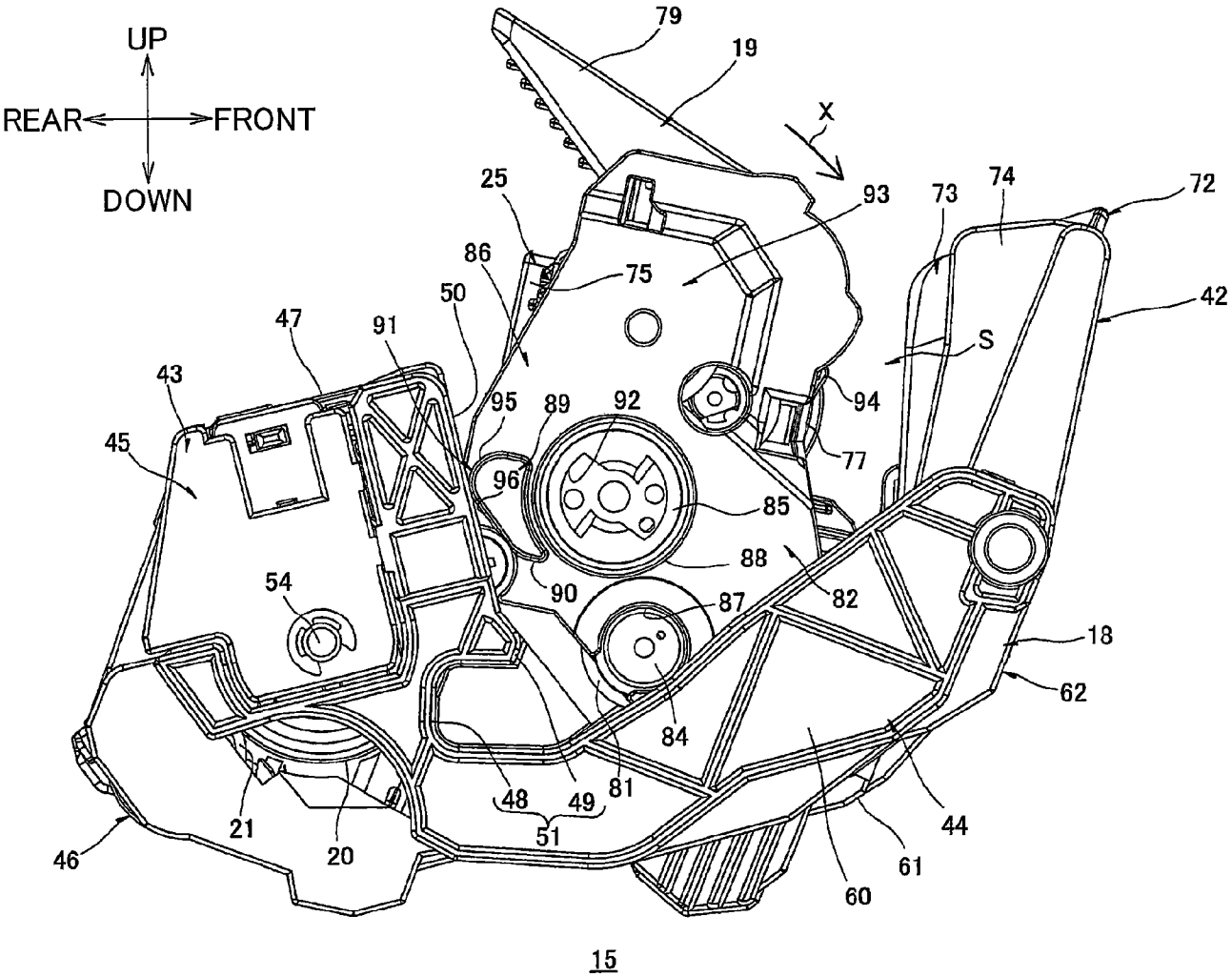
FIG. 7 is an explanatory view explaining the operations for mounting and removing the developing cartridge relative to the drum cartridge, following a state shown in FIG. 6, in which a left side view of the process cartridge is shown and the developing cartridge has been removed from the drum cartridge.

In order to mount the developing cartridge 19 in the drum cartridge 18, an operator grips the developing-cartridge grip parts 79 of the developing cartridge 19 and inserts a rear end of the developing cartridge 19 downward into the mounting space S formed in the cartridge-mounting portion 44, as illustrated in FIG. 7.

Through this operation, the collar members 84 contact the top edges of the mounting-portion side walls 60, and the upper surfaces 95 formed on the curved guide surfaces 91 abut against the contact-receiving parts 50 of the accommodating-portion side walls 45 from a front side thereof.

Next, the operator rotates (pivotally moves) the developing cartridge 19 in a mounting direction X (clockwise in a left side view) about points of contact between the upper surfaces 95 and the contact-receiving parts 50.

Figure 6:
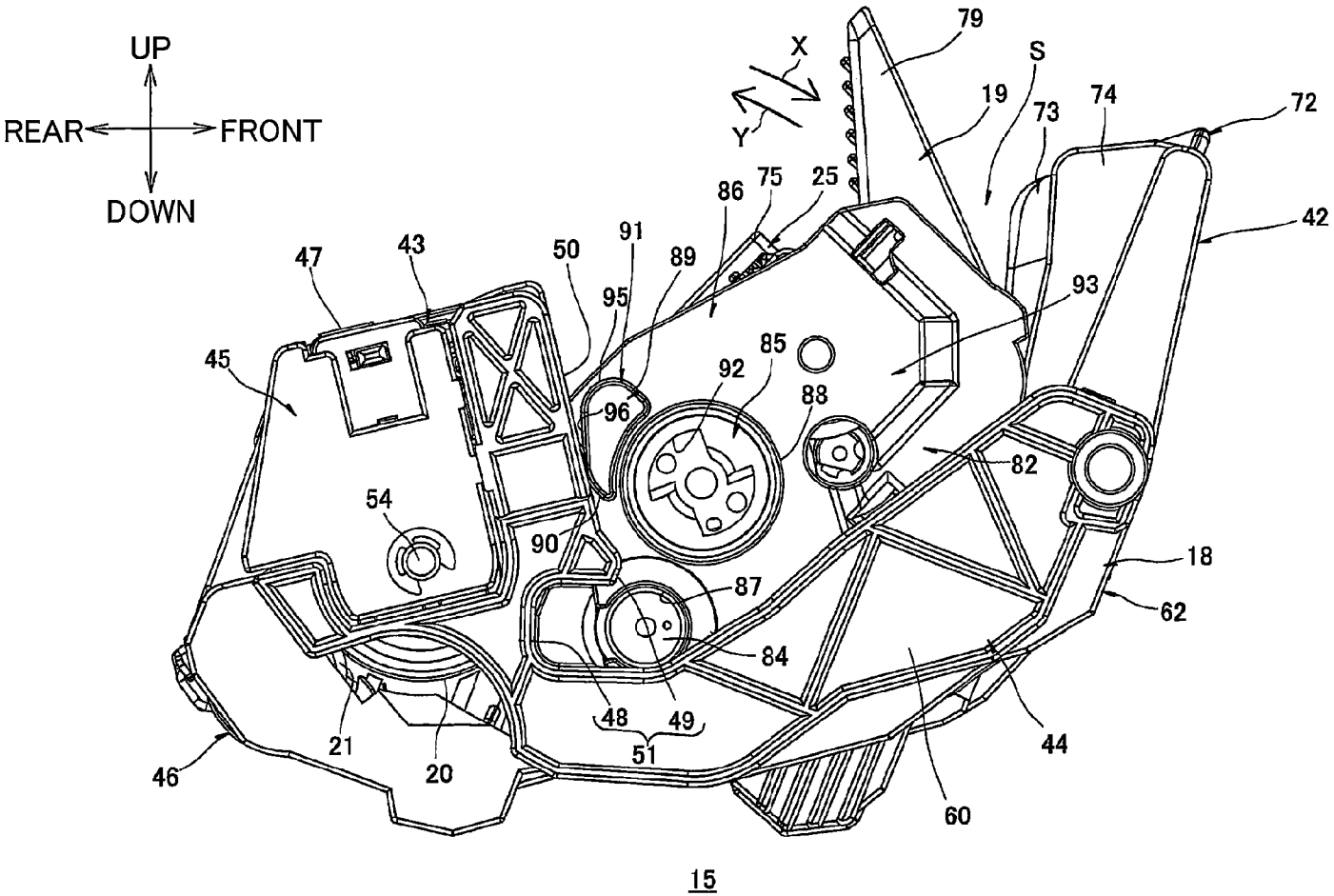
FIG. 6 is an explanatory view explaining the operations for mounting and removing the developing cartridge relative to the drum cartridge, following a state shown in FIG. 5, in which a left side view of the process cartridge is shown and the developing cartridge is in the process of mounting in and removing from the drum cartridge.

Through this operation, the collar members 84 move in a downward and rearward direction along the top edges of the mounting-portion side walls 60, and a front end of the developing cartridge 19 moves diagonally downward and forward, as illustrated in FIG. 6.

When the operator rotates the developing cartridge 19 farther in the mounting direction X, the collar members 84 become inserted into the guiding grooves 48 of the guide parts 51 and the front end of the developing cartridge 19 becomes accommodated in a front portion of the cartridge-mounting portion 44, as shown in FIG. 5. Thus, the guide parts 51 are formed to guide rotation of the developing cartridge 19, while the guiding grooves 48 are formed to extend along the mounting direction X.

Further, the retaining parts 49 of the guide parts 51 oppose the collar members 84 from above and retain the collar members 84 in the vertical direction.

As shown in FIG. 10, the bottom edge of the contact parts 94 of the developing cartridge 19 contact the distal edges of the corresponding contact-receiving parts 65 from above.

Further, the front edges of the protruding parts 100 provided on the developing cartridge 19 contact the projecting parts 71 of the corresponding pressing members 68 from a front side thereof. This contact presses the developing cartridge 19 rearward (toward the photosensitive drum 20) so that the developing-roller body 81 of the developing roller 34 is constantly pressed against the photosensitive drum 20 from a lower front side thereof At this time, the developing cartridge 19 is disposed between the drum-accommodating portion 43, and the front wall 62 and the extension part 72 (first portion) with respect to the front-rear direction, and is accommodated in the mounting space S.

This completes the operation for mounting the developing cartridge 19 in the cartridge-mounting portion 44 of the drum cartridge 18 and forms the process cartridge 15.

At this time, the mounting-portion bottom wall 61 is at a position for confronting the developing cartridge 19 in the vertical direction. As shown in FIG. 5, the accommodating-portion side walls 45 and the mounting-portion side walls 60 are arranged to confront the developing cartridge 19 from respective outer left and right sides thereof.

As shown in FIG. 9B, a right edge of the thick-walled part 59 of the right accommodating-portion side wall 45 is positioned slightly rightward (outward in the axial direction) from a right edge of the power supply unit 83.

As shown in FIG. 5, the top edge of the extension part 72 is positioned above a top edge of the developing cartridge 19, that is, top edges of the developing-cartridge grip parts 79, across the entire left-right dimension of the extension part 72.

In other words, as illustrated in FIG. 10, the front wall 62 and the extension part 72 are integrally formed and extend from the bottom edge of the front wall 62 (an example of a first end) coupled to the front edge of the mounting-portion bottom wall 61 so as to protrude above the developing cartridge 19 in the vertical direction. Further, the front wall 62 and the extension part 72 slope forward away from the developing cartridge 19 from the bottom edge of the front wall 62 toward the top edge (an example of a second end) of the extension part 72.

Further, the drum grip part 73 is provided at the top portion of the extension part 72 so as to be positioned at a top portion of the process cartridge 15. Further, the grip portion 102 of the drum grip part 73 has a top edge positioned higher than the top edges of the developing-cartridge grip parts 79 across the entire left-right dimension of the grip portion 102.

As shown in FIGS. 2 and 5, a top edge of the drum-accommodating portion 43 (top edge of the top wall 47) is positioned higher than a left-right center region of the developing cartridge 19, i.e., a left-right center portion of the developing-cartridge top wall 75 of the developing-cartridge frame 25. In other words, the drum-accommodating portion 43 has a top portion (i.e. top wall 47) protruding farther upward in the vertical direction than the left-right center region of the developing cartridge 19.

As shown in FIG. 5, an imaginary line L1 connecting the top edge of the extension part 72 of the cartridge-mounting portion 44 and the top edge of the top wall 47 of the drum-accommodating portion 43 is positioned higher than the top edges of the developing-cartridge grip parts 79. In other words, the imaginary line L1 is positioned opposite to the mounting-portion bottom wall 61 with respect to the developing cartridge 19.

Further, the developing-cartridge grip parts 79 of the developing cartridge 19 are disposed at a front end portion of the process cartridge 15 so as to be positioned opposite to the drum-accommodating portion 43 with respect to the developing-cartridge frame 25 in the front-rear direction.

More specifically, the developing-cartridge grip parts 79 are arranged to oppose the corresponding pressure-receiving parts 74 of the extension part 72 from respective outer left-right sides thereof, as shown in FIGS. 2 and 9A. When projected in the vertical direction, the developing-cartridge grip parts 79 are aligned with the corresponding pressing members 68, as shown in FIG. 10.

The locking lever 63 shown in FIG. 9A constantly restricts removal of the developing cartridge 19 from the cartridge-mounting portion 44.

More specifically, a left rear portion of the restricting part 98 of the locking lever 63 engages from above a right front portion of the restriction part 97 of the developing cartridge 19, as shown in FIG. 9B. That is, the restricting part 98 is positioned to overlap the restriction part 97 in the removal direction Y (described later; see FIG. 5).

Further, the lifting part 107 of the locking lever 63 (see FIG. 8) is disposed below the protruding part (not shown) of the right developing-cartridge side walls 76 of the developing cartridge 19.

(2) Operation for Removing Developing Cartridge from Drum Cartridge

In order to remove the developing cartridge 19 from the drum cartridge 18, steps in the operation for mounting the developing cartridge 19 described above are performed in reverse.

That is, first the operator moves (rotates) the restricting part 98 of the locking lever 63 forward so as to disengage the restricting part 98 from the restriction part 97.

When the restricting part 98 is moved in this way, the lifting part 107 of the locking lever 63 (see FIG. 8) abuts against the protruding part (not shown) of the developing cartridge 19 from below and pushes the protruding part upward.

Consequently, the developing cartridge 19 rotates (pivotally moves) in the removal direction Y shown in FIGS. 5 and 6, with a front end of the developing cartridge 19 (developing-cartridge grip parts 79) moving upward and rearward. As the developing cartridge 19 rotates, the body parts 69 of the pressing members 68 advance rearward to a position beneath the corresponding contact parts 94 of the developing cartridge 19. Hence, the contact parts 94 contact the body parts 69 from above (see FIG. 10).

Next, the operator grips the developing-cartridge grip parts 79 of the developing cartridge 19 and pulls the developing-cartridge grip parts 79 in a direction diagonally upward and rearward.

At this time, the collar members 84 move forward while being guided by the guiding grooves 48, and connecting areas between the rear surfaces 90 and the connecting surfaces 96 of the curved guide surfaces 91 abut against the corresponding contact-receiving parts 50 on the accommodating-portion side walls 45 from a front side thereof, as shown in FIG. 6.

Next, the developing cartridge 19 is rotated in the removal direction Y (counterclockwise in a left side view) about points of contact between the connecting areas of the curved guide surfaces 91 and the contact-receiving parts 50.

At this time, the collar members 84 are separated from the guiding grooves 48 to a position below and forward of the corresponding retaining parts 49 and above connecting areas between the accommodating-portion side walls 45 and the corresponding mounting-portion side walls 60.

As the operator continues to pull the developing-cartridge grip parts 79 upward and rearward along the removal direction Y, the collar members 84 move upward and forward along the top edges of the corresponding mounting-portion side walls 60, and the upper surfaces 95 of the curved guide surfaces 91 abut against the corresponding contact-receiving parts 50 of the accommodating-portion side walls 45 from a front side thereof, as shown in FIG. 7.

From this state, the operator pulls the developing-cartridge grip parts 79 upward and removes the developing cartridge 19 from the drum cartridge 18.

This completes the operation for removing the developing cartridge 19 from the cartridge-mounting portion 44 of the drum cartridge 18.

Hence, the developing cartridge 19 is rotated (pivotally moved) while being mounted in and removed from the cartridge-mounting portion 44 of the drum cartridge 18.

4. Operation for Mounting Process Cartridge in Main Casing

Next, an operation for mounting the process cartridge 15 in the main casing 2 will be described.

In order to mount the process cartridge 15 in the main casing 2, first the operator places the top cover 7 of the main casing 2 in the open position, as described above and shown in FIG. 1.

Next, the operator grips the drum grip part 73 of the process cartridge 15 and inserts the process cartridge 15 into the main casing 2 through the cartridge access opening 5 so that the left and right end portions of the drum shaft 54 of the photosensitive drum 20 are fitted into the corresponding guide parts 37 provided in the main casing 2.

Next, the operator pushes the process cartridge 15 downward and rearward along the guide parts 37 and rotates (pivotally moves) the process cartridge 15 clockwise in a left side view about the drum shaft 54 of the photosensitive drum 20.

Once the drum shaft 54 of the photosensitive drum 20 is positioned in the rear ends of the guide parts 37 and the extension part 72 of the drum cartridge 18 is positioned below the irradiation path of the laser beam L, the operation for mounting the process cartridge 15 in the main casing 2 is completed.

In this position, the extension part 72 does not interfere with the laser beam L because the extension part 72 is lower than the irradiation path of the laser beam L.

Next, the operator moves the top cover 7 of the main casing 2 from the open position to the closed position.

Figure 11:
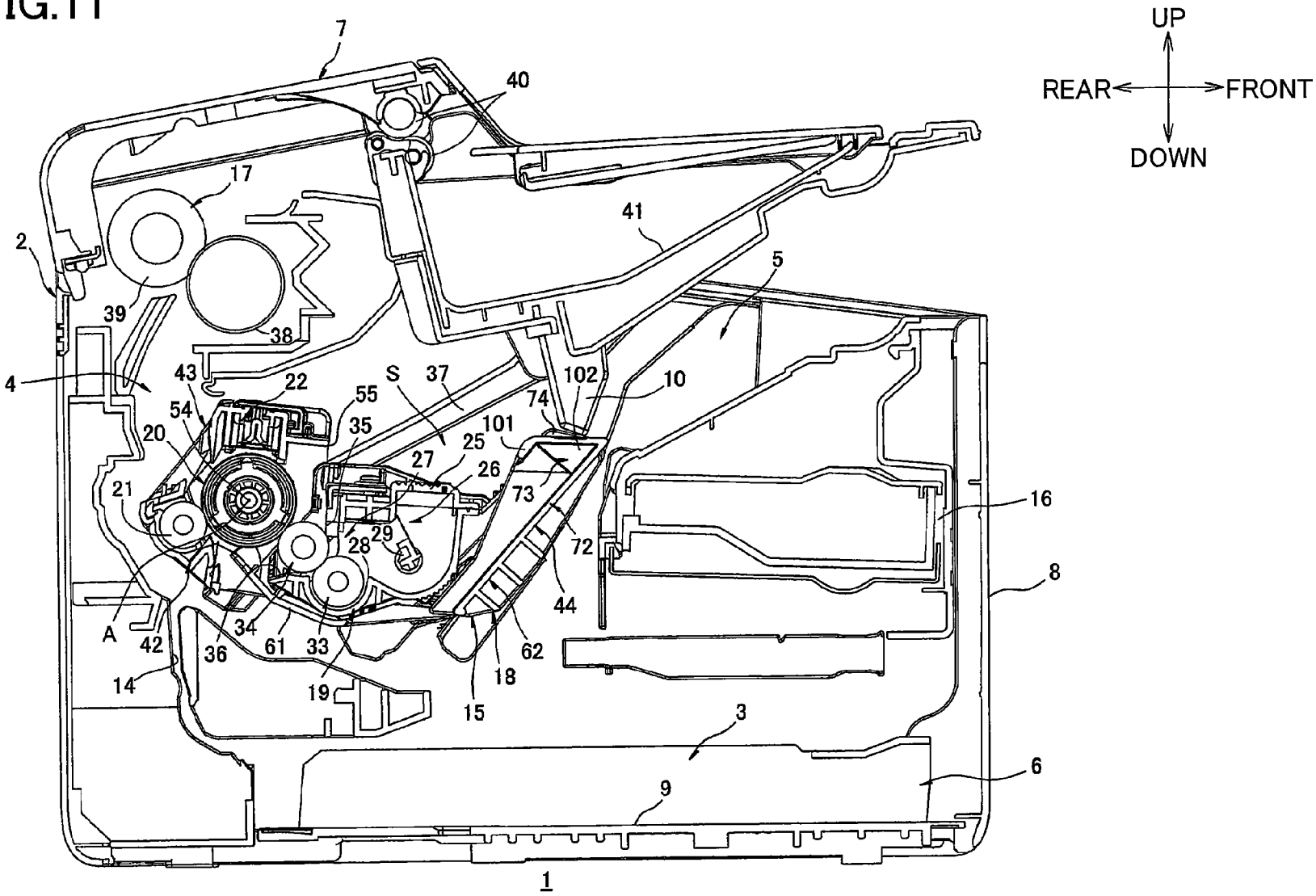
FIG. 11 is an explanatory view explaining how pressing parts of a top cover shown in FIG. 1 presses the process cartridge.

If the process cartridge 15 has not been sufficiently mounted in the main casing 2 at this time, as shown in FIG. 11, the pressing parts 10 will abut against the top edges of the pressure-receiving parts 74.

Thus, as the top cover 7 continues to move to the closed position, the pressing parts 10 press the process cartridge 15 downward through the pressure-receiving parts 74.

This pressure will place the process cartridge 15 in the proper mounted position inside the main casing 2 shown in FIG. 1.

This completes the operation for mounting the process cartridge 15 in the main casing 2.

Further, when the top cover 7 is in the closed position, the pressing parts 10 of the top cover 7 are respectively disposed on outer left and right sides of the irradiation path of the laser beam L and are separated therefrom, and the top cover 7 is positioned above the mounted process cartridge 15. In other words, the pressing parts 10 and the top cover 7 are arranged so as not to interfere with the laser beam L.

5. Operational Advantages (1) As shown in FIG. 5, the cartridge-mounting portion 44 of the process cartridge 15 has the mounting-portion bottom wall 61 that opposes the developing cartridge 19 in the vertical direction (second direction), and the extension part 72 that protrudes upward so as to be higher in the vertical direction than the developing cartridge 19. Further, the upper portion of the drum-accommodating portion 43 (upper edge of the top wall 47) protrudes farther upward than the left-right (axial) center portion of the developing cartridge 19 with respect to the vertical direction.

Therefore, if the process cartridge 15 is impacted on its bottom side (the side of the mounting-portion bottom wall 61 opposite the developing cartridge 19 with respect to the vertical direction), this impact acts on the mounting-portion bottom wall 61. On the other hand, if the process cartridge 15 is impacted on its top side (the side of the developing cartridge 19 opposite the mounting-portion bottom wall 61 with respect to the vertical direction), this impact acts on the top edge of the extension part 72 and the top edge of the drum-accommodating portion 43 (top wall 47).

Hence, impacts incurred on the top and bottom sides of the process cartridge are applied to the mounting-portion bottom wall 61 or to the extension part 72 and the drum-accommodating portion 43 (top wall 47), and act on the drum cartridge 18 through these portions.

Accordingly, this construction suppresses vertical impacts applied to the process cartridge 15 from acting on the developing cartridge 19.

Particularly, when the process cartridge 15 is accidentally dropped, either the mounting-portion bottom wall 61 or the extension part 72 and the drum-accommodating portion 43 (top wall 47) collide with the floor or the like. Hence, the impact resulting from this collision acts on the drum cartridge 18 through the mounting-portion bottom wall 61 or the extension part 72 and the drum-accommodating portion 43, while an impact to the developing cartridge 19 is suppressed. Thus, this construction suppresses leakage of toner from the developing cartridge 19.

Hence, this construction, while simple, can suppress toner leakage from the developing cartridge 19, even when the process cartridge 15 is impacted from the outside in the vertical direction.

(2) As shown in FIG. 5, the developing cartridge 19 is arranged between the extension part 72 and the drum-accommodating portion 43 in the front-rear direction (first direction) when in its mounted state in the cartridge-mounting portion 44.

Hence, the drum-accommodating portion 43 is positioned on the rear side of the developing cartridge 19 and the extension part 72 is positioned on the front side of the developing cartridge 19. In other words, parts that protrude farther in the vertical direction than the developing cartridge 19 (extension part 72 or drum-accommodating portion 43) are provided on each of the front and rear sides of the developing cartridge 19.

Therefore, if the process cartridge 15 incurs an impact on its top side, the impact will reliably act on the extension part 72 and the drum-accommodating portion 43 while being reliably suppressed from acting on the developing cartridge 19.

(3) As shown in FIG. 2, the extension part 72 is formed in a general plate shape that is elongated in the left-right direction.

Accordingly, an impact incurred on the top of the process cartridge 15 is reliably applied to the extension part 72.

Thus, impacts to the top of the process cartridge 15 can be even more reliably suppressed from acting on the developing cartridge 19.

(4) As shown in FIG. 10, the front wall 62 and the extension part 72 slope upward and forward away from the developing cartridge 19, from the bottom edge of the front wall 62 (edge adjacent to the mounting-portion bottom wall 61 with respect to the vertical direction; a first edge) toward the top edge of the extension part 72 (edge opposite the first edge in the vertical direction; a second edge).

Accordingly, this configuration allocates a relatively large space between the developing cartridge 19 and the top edge of the extension part 72.

Thus, impacts incurred on the top edge of the extension part 72 can be even more reliably suppressed from acting on the developing cartridge 19.

(5) As shown in FIG. 10, the extension part 72 is further provided with the drum grip part 73 at its top edge portion (the side opposite the mounting-portion bottom wall 61 in the vertical direction) for gripping the drum cartridge 18.

Accordingly, the operator can grip the drum grip part 73 to handle the process cartridge 15. As a result, this arrangement improves the ease of handling the process cartridge 15.

Since the operator can grip the drum grip part 73 when mounting the process cartridge 15 in the main casing 2 and removing the process cartridge 15 from the main casing 2, this configuration ensures that the mounting and removal operations can be performed smoothly.

(6) As shown in FIG. 2, the top edge of the grip portion 102 on the drum grip part 73 (edge opposite the mounting-portion bottom wall 61 in the vertical direction) is positioned higher in the vertical direction than the developing-cartridge grip parts 79 across its entire left-right dimension.

Accordingly, the operator can easily access the drum grip part 73.

(7) As shown in FIG. 10, the drum grip part 73 has the grip portion 102 that protrudes rearward (toward the drum-accommodating portion 43 in the front-rear direction) from the rear surface of the extension part 72.

Further, the rear end on the top edge of the grip portion 102 (downstream end in the protruding direction) is positioned below (on the mounting-portion bottom wall 61 side of) the front end on the top edge of the grip portion 102 (upstream end in the protruding direction).

Accordingly, this construction can further improve the ease of handling the process cartridge 15 by facilitating the user in gripping the drum grip part 73.

(8) Further, as shown in FIGS. 5 through 7, the developing cartridge 19 is rotated (pivotally moved) when mounted in and removed from the cartridge-mounting portion 44.

In order for the developing cartridge 19 to be detachably accommodated in the cartridge-mounting portion 44, the mounting space S for mounting and removing the developing cartridge 19 must be formed in the cartridge-mounting portion 44.

Here, the size of the mounting space S can be reduced since the developing cartridge 19 is rotated when mounted and removed, as illustrated in FIGS. 5 through 7.

Consequently, the cartridge-mounting portion 44 can be made more compact, which in turn enables the process cartridge 15 to be made more compact.

As shown in FIG. 5, the drum frame 42 is also provided with the accommodating-portion side walls 45 and the mounting-portion side walls 60 that confront the developing cartridge 19 from the outer left-right sides (from the outer sides in the axial direction).

Therefore, impacts incurred on the left and right sides of the process cartridge 15 act on the drum cartridge 18 via the accommodating-portion side walls 45 and the mounting-portion side walls 60.

Thus, this construction suppresses impacts applied to the left and right sides of the process cartridge 15 from acting on the developing cartridge 19.

Further, the accommodating-portion side walls 45 and the mounting-portion side walls 60 are provided with the guide parts 51 for guiding rotation of the developing cartridge 19.

Hence, the guide parts 51 guide the rotation of the developing cartridge 19, as shown in FIGS. 5 through 7, to ensure the rotating operation progresses smoothly.

(9) As shown in FIG. 5, the guide parts 51 have the guiding grooves 48 that extend along the mounting direction X of the developing cartridge 19. The developing cartridge 19 also includes the collar members 84 that protrude outward in the left-right direction.

When the developing cartridge 19 is mounted in and removed from the cartridge-mounting portion 44, the guiding grooves 48 guide the collar members 84 on the developing cartridge 19.

Accordingly, this construction ensures smooth operations for mounting the developing cartridge 19 in and removing the developing cartridge 19 from the cartridge-mounting portion 44.

The developing cartridge 19 also includes the curved guide surfaces 91 that protrude outward in the respective left and right directions.

As shown in FIGS. 6 and 7, the curved guide surfaces 91 abut against the corresponding contact-receiving parts 50 of the drum-accommodating portion 43, while the collar members 84 are guided in the guide parts 51, i.e., while the developing cartridge 19 is being mounted and removed.

Hence, the developing cartridge 19 can smoothly rotate about the points of contact between the curved guide surfaces 91 and the contact-receiving parts 50, thereby ensuring a smooth rotational operation for the developing cartridge 19.

(10) As shown in FIG. 9B, the developing cartridge 19 is also provided with the power supply unit 83 on the right side of the developing-cartridge frame 25. The power supply unit 83 can be electrically connected to the main electrode (not shown) provided in the main casing 2.

Hence, a bias voltage can be supplied from the main electrode (not shown) to the developing cartridge 19 through the power supply unit 83.

Further, the thick-walled part 59 is provided on the right accommodating-portion side wall 45 with the right edge of the thick-walled part 59 positioned slightly rightward (outward in the axial direction) than the right edge of the power supply unit 83.

Hence, impacts incurred on the right side of the process cartridge 15 reliably act on the thick-walled part 59 provided on the right accommodating-portion side wall 45.

Thus, the developing cartridge 19 can be provided with the power supply unit 83 while this construction suppresses impacts applied to the right side of the process cartridge 15 from acting on the developing cartridge 19.

(11) As shown in FIG. 9B, the cartridge-mounting portion 44 is also provided with the locking lever 63 for restricting removal of the developing cartridge 19 from the cartridge-mounting portion 44.

Further, the developing cartridge 19 is provided with the restriction part 97 for engaging with the locking lever 63, whereby the locking lever 63 is positioned to overlap the restriction part 97 when projected in the vertical direction (and more specifically in the removal direction Y of the developing cartridge 19; see FIG. 5).

Accordingly, this configuration can restrict the developing cartridge 19 from separating unexpectedly from the cartridge-mounting portion 44.

That is, this configuration suppresses the developing cartridge 19 from separating from the cartridge-mounting portion 44 when the process cartridge 15 is accidentally dropped. Therefore, this configuration reliably suppresses impacts from acting on the developing cartridge 19 when the process cartridge 15 is dropped.

(12) As shown in FIG. 10, the developing cartridge 19 is also provided with the developing-cartridge grip parts 79 on its front end portion (on the side opposite the drum-accommodating portion 43 in the front-rear direction). The operator grips the developing-cartridge grip parts 79 when mounting and removing the developing cartridge 19 relative to the cartridge-mounting portion 44.

Accordingly, by gripping the developing-cartridge grip parts 79 when mounting the developing cartridge 19 in the cartridge-mounting portion 44 or removing the developing cartridge 19 from the cartridge-mounting portion 44, the operator can perform the mounting and removal operations smoothly.

The pressing members 68 are also provided on the cartridge-mounting portion 44 so as to overlap the developing-cartridge grip parts 79 when projected in the vertical direction.

The pressing members 68 constantly press the developing cartridge 19 rearward toward the photosensitive drum 20.

Accordingly, this configuration can improve the precision in positioning the developing cartridge 19 relative to the photosensitive drum 20. Further, positioning the developing-cartridge grip parts 79 and the pressing members 68 so as to overlap each other as viewed in the vertical direction ensures an efficient arrangement of these components.

(13) As shown in FIG. 10, the contact parts 94 are provided on the developing-cartridge bottom wall 77 of the developing cartridge 19 for contacting the mounting-portion bottom wall 61.

The contact-receiving parts 65 are also provided on the mounting-portion bottom wall 61 of the drum cartridge 18 for receiving the contact of the contact parts 94.

This construction can improve the precision in positioning the mounted developing cartridge 19 relative to the cartridge-mounting portion 44.

Further, the contact-receiving parts 65 are disposed on the lower front side (upstream side in the removal direction Y of the developing cartridge 19) of the pressing members 68.

This ensures an efficient arrangement of the contact-receiving parts 65 and the pressing members 68.

(14) As shown in FIG. 10, the drum-accommodating portion 43 is provided with the scorotron charger 22 that is configured to charge the photosensitive drum 20.

Hence, the photosensitive drum 20 can be reliably charged.

(15) As shown in FIG. 1, the scanning unit 16 is provided in the printer 1, while the extension part 72 is disposed so as not to interfere with the laser beam L emitted from the scanning unit 16.

Accordingly, the scanning unit 16 can reliably expose the photosensitive drum 20 to form an electrostatic latent image thereon.

Thus, an electrostatic latent image can be formed reliably on the photosensitive drum 20 while the process cartridge 15 is provided with the extension part 72.

(16) As shown in FIG. 1, the extension part 72 is disposed so as to be well below (on one side in the second direction of) the laser beam L.

Hence, this arrangement reliably prevents the extension part 72 from interfering with the laser beam L.

(17) As shown in FIG. 1, the main casing 2 is also provided with the top cover 7, which is capable of moving in the vertical direction. The top cover 7 is further provided with the pressing parts 10.

If the process cartridge 15 is still in the process of being mounted in the main casing 2 (if the process cartridge 15 is not fully mounted in the main casing 2) when the top cover 7 is moved from the open position toward the closed position, the pressing parts 10 will contact the top ends of the pressure-receiving parts 74 provided on the extension part 72, as illustrated in FIG. 11.

As the top cover 7 continues to move, the pressing parts 10 push the process cartridge 15 downward (toward one side in the second direction) through the pressure-receiving parts 74.

Consequently, the process cartridge 15 is moved from its not-fully-mounted position to the prescribed mounted position.

Thus, the process cartridge 15 can be reliably mounted in the main casing 2 by moving (pivoting) the top cover 7.

(18) As shown in FIG. 1, the pressing parts 10 are positioned well outside the irradiation path of the laser beam L in the left-right direction (axial direction).

Therefore, this arrangement reliably prevents the pressing parts 10 from interfering with the laser beam L.

(19) Further, the top cover 7 is disposed well above (toward another side in the second direction) the mounted process cartridge 15 when the top cover 7 is in the closed position.

Accordingly, a vertical space can be allocated between the process cartridge 15 and the top cover 7 to allow passage of the laser beam L.

6. Second Embodiment

Next, a process cartridge 115 according to a second embodiment of the present invention will be described while referring to FIGS. 12A and 12B. In the following description, only parts differing from those of the first embodiment will be described in detail.

Figure 12A:
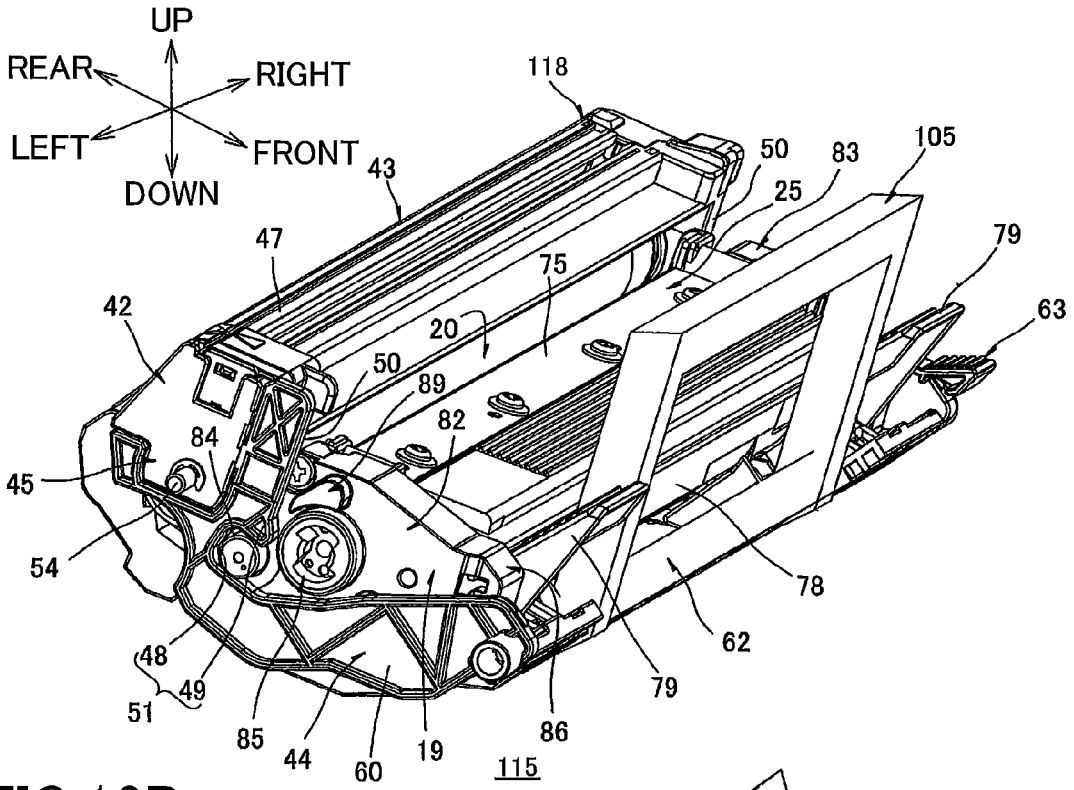
FIG. 12A is a perspective view of a process cartridge according to a second embodiment of the present invention as viewed from its upper left side.
Figure 12B:
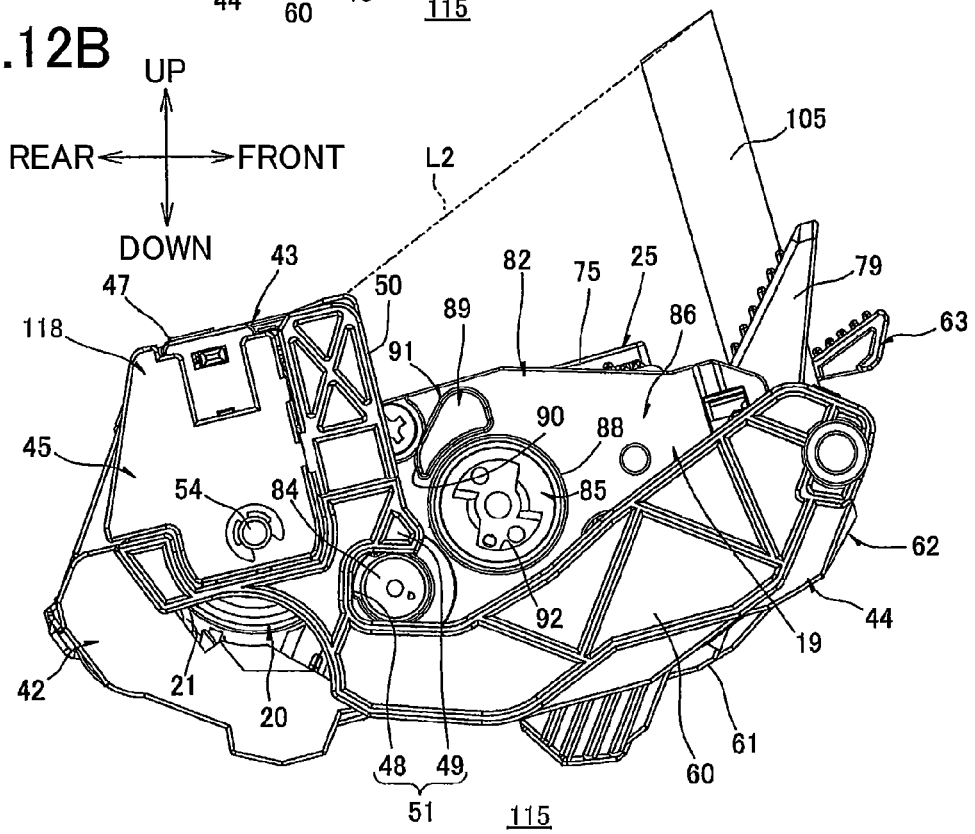
FIG. 12B is a left side view of the process cartridge shown in FIG. 12A.

In FIGS. 12A and 12B, parts corresponding to those in FIGS. 1 through 11 are designated with the same reference numerals to avoid duplicating description.

In the process cartridge 15 according to the first embodiment shown in FIG. 2, the drum cartridge 18 includes the extension part 72 that is formed integrally with the front wall 62 of the cartridge-mounting portion 44.

However, in the process cartridge 115 according to the second embodiment shown in FIG. 12, a drum cartridge 118 is provided with a drum grip part 105 that is separable from the front wall 62 of the cartridge-mounting portion 44.

As shown in FIG. 12A, the drum grip part 105 is formed in a general U-shape in a front side view with an opening of the "U" facing downward. In the second embodiment, the drum grip part 105 serves as an example of a first portion.

The drum grip part 105 is molded separately from the front wall 62 and is subsequently fixed to the front wall 62 and assembled on the cartridge-mounting portion 44 of the drum frame 42 with distal ends of the drum grip part 105 straddling the left-right center region of the top edge of the front wall 62.

In this way, the extension part 72 can be more easily molded than when the extension part 72 is integrally molded with the front wall 62, thereby reducing manufacturing costs.

As shown in FIG. 12B, a top edge of the drum grip part 105 is positioned higher than the top edges of the developing-cartridge grip parts 79 across the entire left-right dimension of the drum grip part 105. Further, an imaginary line L2 connecting the top edge of the drum grip part 105 and the top edge of the top wall 47 of the drum-accommodating portion 43 is positioned higher than the top edges of the developing-cartridge grip parts 79.

Therefore, the second embodiment can obtain the same operational advantages described above in the first embodiment.

7. Third Embodiment

Next, a process cartridge 215 according to a third embodiment of the present invention will be described while referring to FIGS. 13A and 13B. In the following description, only parts differing from those of the first and second embodiments will be described in detail.

Figure 13A:
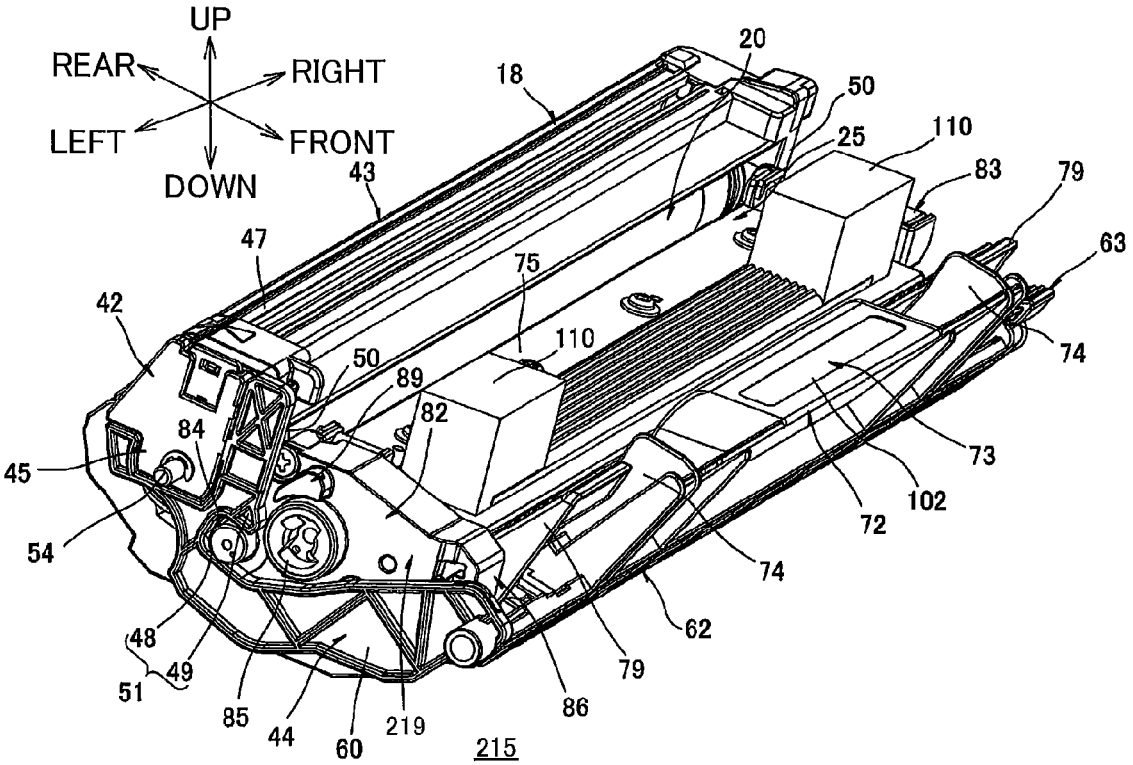
FIG. 13A is a perspective view of a process cartridge according to a third embodiment of the present invention as viewed from its upper left side.
Figure 13B:
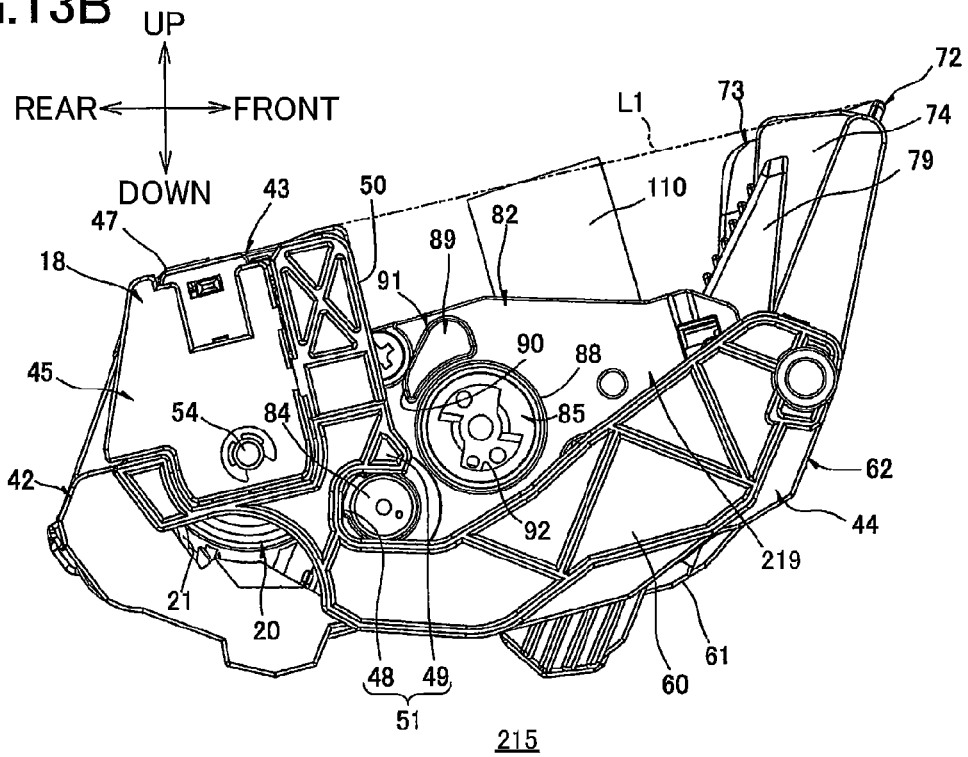
FIG. 13B is a left side view of the process cartridge shown in FIG. 13A.

In FIGS. 13A and 13B, parts corresponding to those in FIGS. 1 through 12B are designated with the same reference numerals to avoid duplicating description.

In the process cartridge 15 according to the first embodiment and the process cartridge 115 according to the second embodiment described above, the developing-cartridge top wall 75 of the developing-cartridge frame 25 is disposed beneath the top edge of the drum-accommodating portion 43 across its entire left-right dimension, as shown in FIGS. 2 and 12B.

However, in the process cartridge 215 according to the third embodiment shown in FIGS. 13A and 13B, a developing cartridge 219 is provided with an extension part 110 disposed on each of left and right end portions of the developing-cartridge top wall 75 of the developing-cartridge frame 25. Top edges of the extension parts 110 are positioned higher than the top edge of the drum-accommodating portion 43.

As shown in FIG. 13B, the extension parts 110 are formed in a general box-like shape that is open on a bottom side thereof. In a side view, the extension parts 110 are formed in a general rectangular shape and protrude diagonally upward and rearward from the top surface of the developing-cartridge top wall 75. The extension parts 110 have internal spaces in fluid communication with the toner-accommodating chamber 26 through openings (not shown) formed in the developing-cartridge top wall 75.

Since the top edge of the drum-accommodating portion 43 (top edge of the top wall 47) is positioned higher than the left-right center portion of the developing-cartridge top wall 75 of the developing-cartridge frame 25, as shown in FIG. 13A, the third embodiment can obtain the same operational advantages described above in the first embodiment.

Further, since the extension parts 110 provided on the developing-cartridge top wall 75 are in communication with the toner-accommodating chamber 26, the capacity of the developing-cartridge frame 25 can be increased, thereby improving the toner-filling capacity of the developing-cartridge frame 25.

8. Variations and Modifications of Embodiments

The printer 1 described above is an example of the image forming apparatus of the present invention, but the present invention is not limited to the embodiments described above.

In addition to the monochromatic printer described above, the image forming apparatus of the present invention may be configured as a color printer.

When configured as a color printer, the image forming apparatus may be configured as a direct tandem type color printer provided with a plurality of photosensitive members, and a recording medium conveying member; or as an intermediate-transfer tandem type color printer provided with a plurality of photosensitive members, an intermediate transfer body, and a transfer member.

The developing cartridge 19 may also be configured of a frame having the developing roller 34, and a toner cartridge for accommodating toner that is detachably mounted in the frame.

In place of the photosensitive drum 20 described above, a photosensitive belt or other member may be used as a photosensitive member.

Instead of the developing roller 34 described above, a developing sleeve, a developing belt, a brush roller, or other member may be used as a developer-carrying member.

Instead of the supply roller 33 described above, a supply sleeve, a supply belt, a brush roller, or other member may be used as a supply member.

Instead of the agitator 29 described above, an auger screw, a conveying belt, or other member may be used as a conveying member.

Instead of the transfer roller 21 described above, a contact-type transfer member such as a transfer belt, a transfer brush, a transfer blade, and a film-type transfer device, or a non-contact-type transfer member such as a corotron-type transfer member may be used as a transfer member.

Instead of the scorotron charger 22 described above, a corotron-type charger, a non-contact-type charger such as a charger provided with a saw-tooth discharge member, or a contact-type charger such as a charging roller may be used as the charger.

As shown in FIG. 3, the extension part 72 described above is provided in the approximate left-right center region of the drum frame 42 and specifically in the approximate left-right center region on the top edge of the front wall 62. However, one extension part 72 may be provided on each of the left and right end portions of the drum frame 42.

More specifically, the extension parts 72 may be provided on the top edge of the front wall 62, with one on each of the left and right sides, so as to be disposed forward of the developing-cartridge grip parts 79.

Further, while the extension part 72 described above is provided on the front end of the drum frame 42, and specifically on the front wall 62, the present invention is not limited to this arrangement, provided that the extension part 72 protrudes above the top edge of the mounting-portion side wall 60.

As shown in FIG. 4, the developing-cartridge grip parts 79 described above are integrally provided on the developing-cartridge frame 25 of the developing cartridge 19. However, the developing-cartridge grip parts 79 may be provided as separate members from the developing-cartridge frame 25.

The image forming apparatus of the present invention may also be configured as a multifunction peripheral that is equipped with an image-reading unit and the like.

These variations can also obtain the same operational advantages described above in the first through third embodiments.

Note that the first through third embodiments and the variations described above may also be arbitrarily combined.

While the present invention has been described in detail with reference to the embodiments thereof, it would be apparent to those skilled in the art that various changes and modifications may be made therein without departing from the spirit of the present invention.

What is claimed is:

1. A process cartridge comprising:

a developer cartridge configured to accommodate toner therein; and a photosensitive-member cartridge configured to detachably mount the developer cartridge therein, the photosensitive-member cartridge comprising:

a casing; and a photosensitive member supported in the casing and configured to rotate about an axis extending in an axial direction, the casing including:

a photosensitive-member accommodating portion configured to accommodate the photosensitive member therein; and a cartridge-accommodating portion disposed next to the photosensitive-member accommodating portion in a first direction and configured to accommodate the developer cartridge therein, the cartridge-accommodating portion including a first wall and a first portion for defining a space in which the developer cartridge is accommodated, the first wall extending in the first direction and confronting the developer cartridge in a second direction intersecting the first direction, the first wall having a first end and a second end opposite to the first end in the first direction, the second end being positioned farther away from the photosensitive-member accommodating portion in the first direction than the first end from the photosensitive-member accommodating portion, the first portion extending from the second end in the second direction so as to protrude further than the developer cartridge in the second direction, the first portion having a first end continuous from the second end of the first wall and a second end opposite to the first end of the first portion in the second direction, the first portion being provided with a grip portion through which an operator grips the photosensitive-member cartridge, the grip portion being disposed at the second end of the first portion, and the grip portion being positioned farther away from the first wall in the second direction than the developer cartridge from the first wall, wherein the photosensitive-member accommodating portion includes a second portion protruding in the second direction further than a center region in the axial direction of the developer cartridge.

2. The process cartridge as claimed in claim 1, wherein the developer cartridge is disposed between the photosensitive-member accommodating portion and the first portion in the first direction.

3. The process cartridge as claimed in claim 1, wherein the first portion has a general plate shape extending in the axial direction.

4. The process cartridge as claimed in claim 1, wherein the first portion has a first end continuous from the second end of the first wall and a second end opposite to the first end of the first portion in the second direction, the first portion sloping from the first end of the first portion toward the second end of the first portion so as to be away from the developer cartridge in the first direction.

5. The process cartridge as claimed in claim 1, wherein the grip portion has a first end and a second end opposite to the first end of the grip portion in the second direction, the second end of the grip portion being positioned opposite to the first wall with respect to the first end of the grip portion in the second direction and having a dimension in the axial direction, the second end of the grip portion protruding further than the developer cartridge in the second direction across the dimension in its entirety.

6. The process cartridge as claimed in claim 1, wherein the grip portion has a protruding wall protruding in a third direction opposite to the first direction from the first portion toward the photosensitive-member accommodating portion, the protruding wall having a downstream end and an upstream end in the third direction, the protruding wall sloping from the upstream end toward the downstream end such that the downstream end is closer to the first wall in the second direction than the upstream end to the first wall.

7. The process cartridge as claimed in claim 1, wherein the developer cartridge is configured to be mounted in and removed from the cartridge-accommodating portion while pivotally moving, wherein the casing includes a second wall confronting the developer cartridge from an outer side thereof in the axial direction, and wherein the second wall is provided with a guide portion configured to guide pivotal movement of the developer cartridge.

8. The process cartridge as claimed in claim 7, wherein the developer cartridge is mounted in the cartridge-accommodating portion in a mounting direction, wherein the guide portion has a groove portion extending in the mounting direction, and wherein the developer cartridge has a guided portion protruding outward in the axial direction and configured to be guided by the groove portion, and an abutting portion protruding outward in the axial direction and configured to abut against the photosensitive-member accommodating portion while the guided portion is being guided by the guide portion.

9. The process cartridge as claimed in claim 7, wherein the developer cartridge includes an electrode configured to be electrically connected to an external power supply, and wherein the second wall has a portion positioned further outward in the axial direction than the electrode.

10. The process cartridge as claimed in claim 1, wherein the developer cartridge is removed from the cartridge-accommodating portion in a removal direction, wherein the cartridge-accommodating portion is provided with a restricting member configured to restrict removal of the developer cartridge from the cartridge-accommodating portion, wherein the developer cartridge includes a restriction portion configured to engage the restricting member, and wherein the restricting member is positioned to overlap the restriction portion when projected in the removal direction.

11. The process cartridge as claimed in claim 1, wherein the developer cartridge includes a cartridge casing having a first end confronting the photosensitive-member accommodating portion and a second end opposite to the first end of the cartridge casing in the first direction, wherein the developer cartridge includes a handgrip through which an operator mounts and removes the developer cartridge in and from the cartridge-accommodating portion, the handgrip being disposed at the second end of the cartridge casing, and wherein the cartridge-accommodating portion is provided with a pressing member configured to press the developer cartridge toward the photosensitive member, the pressing member being positioned to overlap the handgrip when projected in the second direction.

12. The process cartridge as claimed in claim 11, wherein the developer cartridge is removed from the cartridge-accommodating portion in a removal direction, wherein the developer cartridge has a contact portion configured to contact the first wall, and wherein the first wall has a contact-receiving portion configured to receive contact with the contact portion, the contact-receiving portion being positioned upstream of the pressing member in the removal direction.

13. The process cartridge as claimed in claim 1, wherein the photosensitive-member cartridge further comprises a charger configured to charge the photosensitive member, the charger being disposed at the photosensitive-member accommodating portion.

14. The process cartridge as claimed in claim 1, wherein the first portion is configured to be separable from the cartridge-accommodating portion.

15. An image forming apparatus comprising:

a process cartridge comprising:

a developer cartridge configured to accommodate toner therein; and a photosensitive-member cartridge configured to detachably mount the developer cartridge therein, the photosensitive-member cartridge comprising:

a casing; and a photosensitive member supported in the casing and configured to rotate about an axis extending in an axial direction, the casing including:

a photosensitive-member accommodating portion configured to accommodate the photosensitive member therein; and a cartridge-accommodating portion disposed next to the photosensitive-member accommodating portion in a first direction and configured to accommodate the developer cartridge therein, the cartridge-accommodating portion including a first wall and a first portion for defining a space in which the developer cartridge is accommodated, the first wall extending in the first direction and confronting the developer cartridge in a second direction intersecting the first direction, the first wall having a first end and a second end opposite to the first end in the first direction, the second end being positioned farther away from the photosensitive-member accommodating portion in the first direction than the first end from the photosensitive-member accommodating portion, the first portion extending from the second end in the second direction so as to protrude further than the developer cartridge in the second direction, the first portion having a first end continuous from the second end of the first wall and a second end opposite to the first end of the first portion in the second direction, the first portion being provided with a grip portion through which an operator grips the photosensitive-member cartridge, the grip portion being disposed at the second end of the first portion, and the grip portion being positioned farther away from the first wall in the second direction than the developer cartridge from the first wall, wherein the photosensitive-member accommodating portion includes a second portion protruding in the second direction further than a center region in the axial direction of the developer cartridge;

a main casing configured to accommodate the process cartridge therein; and an exposure device configured to irradiate a laser beam toward the photosensitive member along an irradiation path to expose the photosensitive member to the laser beam, the exposure device being disposed in confrontation with and spaced apart from the process cartridge in the first direction, the first portion being configured so as to avoid interference with the laser beam in a state where the process cartridge is mounted in the main casing.

16. The image forming apparatus as claimed in claim 15, wherein the first portion is positioned away from the irradiation path of the laser beam in a fourth direction opposite to the second direction.

17. The image forming apparatus as claimed in claim 15, wherein the main casing is provided with a movable member configured to move in the second direction and a fourth direction opposite to the second direction, wherein the movable member has a pressing portion configured to press the first portion in the fourth direction to complete mounting of the process cartridge in the main casing, wherein the pressing portion is configured so as to avoid interference with the laser beam.

18. The image forming apparatus as claimed in claim 17, wherein the pressing portion is positioned away from and outside the irradiation path of the laser beam in the axial direction.

19. The image forming apparatus as claimed in claim 17, wherein the movable member is positioned away from the process cartridge mounted in the main casing in the second direction.

* * * * *